US012247818B2

(12) United States Patent
Padgett et al.

(10) Patent No.: US 12,247,818 B2
(45) Date of Patent: Mar. 11, 2025

(54) POLYMER AMMUNITION ARTICLE DESIGNED FOR USE ACROSS A WIDE TEMPERATURE RANGE

(71) Applicant: PCP TACTICAL, LLC, Sebastian, FL (US)

(72) Inventors: Charles Padgett, Sebastian, FL (US); Mark A. Sanner, Mt. Vernon, IN (US); Ernest Ford Caldwell, Bergen op Zoom (NL); Gerould Harding, Pittsfield, MA (US); Christopher Wall, Pittsfield, MA (US)

(73) Assignee: PCP Tactical, LLC, Sebastian, FL (US)

( * ) Notice: Subject to any disclaimer, the term of this patent is extended or adjusted under 35 U.S.C. 154(b) by 0 days.

(21) Appl. No.: 17/293,724

(22) PCT Filed: Jul. 26, 2019

(86) PCT No.: PCT/US2019/043728

§ 371 (c)(1),
(2) Date: May 13, 2021

(87) PCT Pub. No.: WO2020/028182

PCT Pub. Date: Feb. 6, 2020

(65) Prior Publication Data

US 2022/0011078 A1 Jan. 13, 2022

Related U.S. Application Data

(60) Provisional application No. 62/760,732, filed on Nov. 13, 2018.

(51) Int. Cl.
*F42B 5/307* (2006.01)

(52) U.S. Cl.
CPC ..... *F42B 5/307* (2013.01)

(58) Field of Classification Search
CPC ..... F42B 5/307; F42B 5/30
(Continued)

(56) References Cited

U.S. PATENT DOCUMENTS 498,856 A 6/1893 Overbaugh
517,719 A 4/1894 Aiken
(Continued)

FOREIGN PATENT DOCUMENTS

AU 1350583 A 10/1983
BE 709551 A 5/1968
(Continued)

OTHER PUBLICATIONS

International Search Report issued in corresponding International Patent Application No. PCT/US2019/043728 dated Oct. 4, 2019.
(Continued)

*Primary Examiner* — Jonathan C Weber
(74) *Attorney, Agent, or Firm* — Troutman Pepper Locke LLP

(57) ABSTRACT

An ammunition article including a polymer cartridge case with a mouth at a first end, a second end opposite the first end, and a propellant chamber located between the first end and the second end. A projectile can be fitted into the mouth and a metal base insert can be joined at the second end. The metal base insert can include a primer. The metal base insert and the polymer cartridge case remain joined together as a single piece assembly upon loading, firing and removal from a chamber of a firearm for a polymer case temperature between about −65° F. (−54° C.) to about 165° F. (74° C.).

7 Claims, 7 Drawing Sheets

(58) Field of Classification Search
USPC ..... 102/464–467
See application file for complete search history.

(56) References Cited

U.S. PATENT DOCUMENTS

| | | | |
|---|---|---|---|
| 539,327 | A | 5/1895 | Aiken |
| 546,936 | A | 9/1895 | Pinfold |
| 692,819 | A | 2/1902 | Bissel |
| 812,156 | A | 2/1906 | Sparre |
| 827,600 | A | 7/1906 | Bailey |
| 980,351 | A | 1/1911 | Sherman |
| 1,038,078 | A | 9/1912 | Bjorgum |
| 1,118,888 | A | 11/1914 | Butler |
| 1,233,071 | A | 7/1917 | Lindquist |
| 1,292,359 | A | 1/1919 | Nelson |
| 1,319,185 | A | 10/1919 | Smith et al. |
| 2,022,685 | A | 12/1935 | Moore |
| 2,263,941 | A | 11/1941 | Norman |
| 2,294,822 | A | 9/1942 | Norman |
| 2,366,887 | A | 1/1945 | Warren |
| 2,379,510 | A | 7/1945 | Ewart |
| 2,395,460 | A | 2/1946 | Carten |
| 2,401,050 | A | 5/1946 | Cooper et al. |
| 2,402,068 | A | 6/1946 | Meador |
| 2,426,448 | A | 8/1947 | Goldfisher |
| 2,435,590 | A | 2/1948 | Holroyd |
| 2,455,080 | A | 11/1948 | Miller et al. |
| 2,481,726 | A | 9/1949 | Muschamp |
| 2,489,953 | A | 11/1949 | Dennistoun |
| 2,648,258 | A | 8/1953 | Simpson |
| 2,654,319 | A | 10/1953 | Roske |
| 2,862,446 | A | 12/1958 | Lars |
| 2,915,424 | A | 12/1959 | Albert |
| 2,915,947 | A | 12/1959 | Heeley |
| 2,918,868 | A | 12/1959 | Lars |
| 2,972,947 | A | 2/1961 | Fitzsimmons et al. |
| 2,995,090 | A | 8/1961 | Daubenspeck |
| 3,034,433 | A | 5/1962 | Gronn |
| 3,048,104 | A | 8/1962 | Riggs |
| 3,078,765 | A | 2/1963 | Falcone et al. |
| 3,099,958 | A | 8/1963 | Daubenspeck et al. |
| 3,123,003 | A | 3/1964 | Lange, Jr. et al. |
| 3,136,052 | A | 6/1964 | Jean-Ghislain |
| 3,144,827 | A | 8/1964 | Boutwell |
| 3,233,546 | A | 2/1966 | Foote et al. |
| 3,253,512 | A | 5/1966 | Schallehn |
| 3,333,506 | A | 8/1967 | Henshaw et al. |
| 3,336,871 | A | 8/1967 | Quinlan |
| 3,339,487 | A | 9/1967 | Umbach et al. |
| 3,351,014 | A | 11/1967 | Metcalf et al. |
| 3,435,765 | A | 4/1969 | Gawlick et al. |
| 3,485,170 | A | 12/1969 | Scanlon |
| 3,491,691 | A | 1/1970 | Vawter |
| 3,609,904 | A | 10/1971 | Scanlon |
| 3,628,225 | A | 12/1971 | Parker |
| 3,650,176 | A | 3/1972 | Lindner |
| 3,659,528 | A | 5/1972 | Santala |
| 3,696,705 | A | 10/1972 | Hrabovsky |
| 3,706,260 | A | 12/1972 | Rausing |
| 3,712,172 | A | 1/1973 | Wiese |
| 3,726,218 | A | 4/1973 | Austin, Jr. |
| 3,732,826 | A | 5/1973 | Johnson |
| 3,745,924 | A | 7/1973 | Scanlon |
| 3,749,020 | A | 7/1973 | Weyhmuller |
| 3,749,021 | A | 7/1973 | Burgess |
| 3,749,023 | A | 7/1973 | Kawaguchi et al. |
| 3,785,293 | A | 1/1974 | Barr et al. |
| 3,797,396 | A | 3/1974 | Reed |
| 3,808,974 | A | 5/1974 | Herter |
| 3,818,834 | A | 6/1974 | Baumgartener |
| 3,830,157 | A | 8/1974 | Donnard et al. |
| 3,842,739 | A | 10/1974 | Scanlon et al. |
| 3,855,686 | A | 12/1974 | Snyder |
| 3,861,308 | A | 1/1975 | Grandy |
| 3,874,294 | A | 4/1975 | Hale |
| 3,913,445 | A | 10/1975 | Grandy |
| 3,935,816 | A | 2/1976 | Boquette, Jr. |
| 3,948,178 | A | 4/1976 | Luther et al. |
| 3,955,506 | A | 5/1976 | Luther et al. |
| 3,977,326 | A | 8/1976 | Anderson et al. |
| 3,983,990 | A | 10/1976 | Gardy et al. |
| 3,990,366 | A | 11/1976 | Scanlon |
| 3,999,482 | A | 12/1976 | Bilek |
| 4,004,491 | A | 1/1977 | Seeling |
| 4,004,492 | A | 1/1977 | Savioli |
| 4,038,923 | A | 8/1977 | Cole et al. |
| 4,089,612 | A | 5/1978 | Mazzeo |
| 4,140,058 | A | 2/1979 | Ballreich et al. |
| 4,142,466 | A | 3/1979 | Ballreich et al. |
| 4,147,107 | A | 4/1979 | Ringdal |
| 4,157,684 | A | 6/1979 | Clausser |
| 4,165,943 | A | 8/1979 | Beach et al. |
| 4,173,186 | A | 11/1979 | Dunham |
| 4,187,271 | A | 2/1980 | Rolston et al. |
| 4,290,339 | A | 9/1981 | Skahill |
| 4,359,925 | A | 11/1982 | Abet et al. |
| 4,446,794 | A | 5/1984 | Simmons |
| 4,469,027 | A | 9/1984 | Burns et al. |
| 4,474,102 | A | 10/1984 | Tassie |
| 4,498,396 | A | 2/1985 | Berube |
| 4,508,036 | A | 4/1985 | Jensen et al. |
| 4,546,704 | A | 10/1985 | Ballreich et al. |
| 4,553,479 | A | 11/1985 | Willoughby |
| 4,562,768 | A | 1/1986 | Weinfurth et al. |
| 4,593,621 | A | 6/1986 | Buchner |
| 4,620,485 | A | 11/1986 | Bertiller |
| 4,683,170 | A | 7/1987 | Tse et al. |
| 4,697,523 | A | 10/1987 | Saxby |
| 4,719,859 | A | 1/1988 | Ballreich et al. |
| 4,726,296 | A | 2/1988 | Leshner et al. |
| 4,738,202 | A | 4/1988 | Hebert |
| 4,790,231 | A | 12/1988 | Stoner |
| 4,803,926 | A | 2/1989 | Barton et al. |
| 4,809,612 | A | 3/1989 | Ballreich et al. |
| 4,841,837 | A | 6/1989 | Novet |
| 4,867,065 | A | 9/1989 | Kaltmann et al. |
| 5,021,206 | A | 6/1991 | Stoops |
| 5,033,386 | A | 7/1991 | Vatsvog |
| 5,063,853 | A | 11/1991 | Bilgeri |
| 5,138,949 | A | 8/1992 | Swartout et al. |
| 5,151,555 | A | 9/1992 | Vatsvog |
| 5,155,295 | A | 10/1992 | Campoli |
| 5,165,040 | A | 11/1992 | Andersson et al. |
| 5,233,928 | A | 8/1993 | Ducros et al. |
| 5,237,930 | A | 8/1993 | Belanger et al. |
| 5,259,288 | A | 11/1993 | Vatsvog |
| 5,259,319 | A | 11/1993 | Dravecky et al. |
| 5,277,119 | A | 1/1994 | Ricco, Sr. |
| 5,359,937 | A | 11/1994 | Dittrich |
| 5,368,526 | A | 11/1994 | Hynes |
| 5,451,632 | A | 9/1995 | Okumura et al. |
| 5,459,914 | A | 10/1995 | Bisping |
| 5,460,096 | A | 10/1995 | Kothe |
| 5,492,063 | A | 2/1996 | Dittrich |
| 5,507,232 | A | 4/1996 | Valdez |
| 5,563,365 | A | 10/1996 | Dineen et al. |
| 5,616,642 | A | 4/1997 | West et al. |
| 5,653,563 | A | 8/1997 | Ernst et al. |
| 5,677,505 | A | 10/1997 | Dittrich |
| 5,703,322 | A | 12/1997 | Tideman |
| 5,708,231 | A | 1/1998 | Koon |
| 5,770,815 | A | 6/1998 | Watson, Jr. |
| 5,804,654 | A | 9/1998 | Lo et al. |
| 5,822,904 | A | 10/1998 | Beal |
| 5,893,959 | A | 4/1999 | Muellich |
| 5,969,288 | A | 10/1999 | Baud |
| 6,040,370 | A | 3/2000 | Wozny et al. |
| 6,048,379 | A | 4/2000 | Bray et al. |
| 6,074,454 | A | 6/2000 | Abrams et al. |
| 6,101,949 | A | 8/2000 | Maucourt et al. |
| 6,131,519 | A | 10/2000 | Thiesen et al. |
| 6,257,149 | B1 | 7/2001 | Cesaroni |
| 6,283,035 | B1 | 9/2001 | Olson et al. |
| 6,305,290 | B1 | 10/2001 | Stimmell |

(56) References Cited

U.S. PATENT DOCUMENTS 6,367,386 B1 4/2002 Brede et al.
6,430,861 B1 8/2002 Ayers et al.
6,439,123 B1 8/2002 Dionne et al.
6,523,476 B1 2/2003 Riess et al.
6,539,874 B2 4/2003 Weise
6,584,909 B2 7/2003 Brede et al.
6,598,536 B2 7/2003 Burri
6,600,002 B2 7/2003 Sanderson et al.
6,748,870 B2 6/2004 Heidenreich et al.
6,752,084 B1 6/2004 Husseini et al.
6,832,557 B2 12/2004 Torsten
6,845,716 B2 1/2005 Husseini et al.
6,862,993 B1 3/2005 Cudazzo
6,886,467 B1 5/2005 Haeselich
7,032,492 B2 4/2006 Meshirer
7,059,234 B2 6/2006 Husseini
7,086,336 B2 8/2006 Smalley, Jr. et al.
7,165,496 B2 1/2007 Reynolds
7,204,191 B2 4/2007 Wiley et al.
7,213,519 B2 5/2007 Wiley et al.
7,231,519 B2 6/2007 Joseph et al.
7,406,908 B1 8/2008 Goon et al.
7,441,504 B2 10/2008 Husseini et al.
7,610,858 B2 11/2009 Chung
7,938,067 B2 5/2011 Dindl et al.
8,087,359 B2 1/2012 Sauvestre
8,146,281 B2 4/2012 Zimmerman
8,151,683 B2 4/2012 Dick et al.
8,240,252 B2 8/2012 Makjkovic et al.
8,342,072 B2 1/2013 Abbott
8,443,730 B2 5/2013 Padgett
8,522,684 B2 9/2013 Davies et al.
8,561,543 B2 * 10/2013 Burrow ..... F42B 33/001 102/466
8,573,126 B2 11/2013 Klein et al.
8,763,535 B2 7/2014 Padgett
8,807,008 B2 8/2014 Padgett et al.
8,813,650 B2 8/2014 Maljkovic et al.
9,032,855 B1 5/2015 Foren
9,182,204 B2 11/2015 Maljkovic
9,188,412 B2 11/2015 Maljkovic et al.
9,296,894 B2 3/2016 Wang et al.
9,335,134 B2 5/2016 Smith
9,335,137 B2 5/2016 Maljkovic et al.
9,395,165 B2 7/2016 Maljkovic
9,964,388 B1 5/2018 Burrow
2003/0019385 A1 1/2003 LeaSure et al.
2003/0167952 A1 9/2003 Heidenreich et al.
2003/0172775 A1 9/2003 Amick
2004/0011237 A1 1/2004 Khvichia et al.
2004/0226472 A1 11/2004 Oda
2004/0237827 A1 12/2004 Smalley et al.
2005/0188879 A1 9/2005 Weley et al.
2005/0188883 A1 9/2005 Husseini et al.
2005/0257711 A1 11/2005 Husseini et al.
2005/0257712 A1 11/2005 Husseini et al.
2006/0011087 A1 1/2006 Husseini et al.
2006/0030664 A1 2/2006 Kim
2006/0102041 A1 5/2006 Wiley et al.
2006/0207464 A1 9/2006 Majkovic et al.
2007/0129492 A1 6/2007 Colborn et al.
2007/0193465 A1 8/2007 Stevens
2007/0214992 A1 9/2007 Dittrich
2007/0261587 A1 11/2007 Chung
2008/0230751 A1 9/2008 Li et al.
2008/0245219 A1 10/2008 Moucheboeuf et al.
2009/0044717 A1 2/2009 Husseini et al.
2009/0069489 A1 3/2009 Vollenberg et al.
2009/0114109 A1 5/2009 Overton et al.
2009/0151710 A1 6/2009 Zimmerman
2009/0249947 A1 10/2009 Coiffet et al.
2009/0314178 A1 12/2009 South
2010/0056687 A1 3/2010 Diakoumakos et al.
2010/0275804 A1 11/2010 Trivette
2010/0282112 A1 11/2010 Battaglia
2010/0305261 A1 12/2010 Maljkovic et al.
2011/0000391 A1 1/2011 Heitmann
2011/0179965 A1 7/2011 Mason
2011/0214583 A1 9/2011 Dutch
2011/0252999 A1 10/2011 Carlson et al.
2011/0290141 A1 12/2011 Engel
2011/0290143 A1 12/2011 Heitmann et al.
2012/0012024 A1 1/2012 Scherrer
2012/0024183 A1 2/2012 Klein
2012/0060716 A1 3/2012 Davies et al.
2012/0111219 A1 5/2012 Burrow
2012/0118132 A1 5/2012 Coker et al.
2012/0144712 A1 6/2012 Rostocil
2012/0174813 A1 7/2012 Battaglia
2012/0180687 A1 7/2012 Padgett et al.
2012/0180688 A1 7/2012 Padgett
2012/0199033 A1 8/2012 Bybee
2012/0318128 A1 12/2012 Gotie
2013/0014664 A1 1/2013 Padgett
2013/0025490 A1 1/2013 Burczynski
2013/0186294 A1 7/2013 Davies et al.
2014/0060372 A1 3/2014 Padgett
2014/0060373 A1 3/2014 Maljkovic et al.
2014/0069290 A1 3/2014 Padgett et al.
2014/0076188 A1 3/2014 Maljkovic et al.
2014/0130699 A1 5/2014 Peterson et al.
2014/0329920 A1 11/2014 Rosenquist
2014/0373744 A1 12/2014 Padgett et al.
2015/0033970 A1 2/2015 Maljkovic et al.
2015/0075400 A1 * 3/2015 Lemke ..... F42B 33/001 86/19.5
2015/0122142 A1 5/2015 Padgett
2015/0316361 A1 11/2015 Maljkovic
2016/0003587 A1 1/2016 Burrow
2016/0003588 A1 1/2016 Burrow
2016/0003601 A1 1/2016 Burrow
2016/0025464 A1 1/2016 Maljkovic et al.
2016/0033241 A1 2/2016 Burrow
2016/0054105 A1 2/2016 Beal
2016/0069654 A1 * 3/2016 Walsh ..... F42B 5/32 102/466
2016/0194495 A1 7/2016 Li et al.
2016/0349022 A1 12/2016 Burrow
2016/0349023 A1 12/2016 Burrow
2016/0349028 A1 12/2016 Burrow
2019/0011233 A1 * 1/2019 Boss ..... C04B 35/64

FOREIGN PATENT DOCUMENTS

CN 101137886 A 3/2008
CN 101528805 A 9/2009
CN 101668799 A 3/2010
CN 103492493 A 1/2014
CN 104823016 A 8/2015
CN 105452378 A 3/2016
CN 105518074 A 4/2016
CN 107466309 A 12/2017
DE 1113880 B 9/1961
DE 2205619 A1 8/1972
DE 2705235 A1 8/1978
DE 3344369 A1 6/1985
EP 0096617 A1 12/1983
EP 0131863 A2 1/1985
EP 0444545 A1 9/1991
EP 0526317 A1 2/1993
FR 1081764 A 12/1954
GB 616755 A 1/1949
GB 732633 A 6/1955
GB 2092274 A 8/1982
JP H03292358 A 12/1991
WO 1988009476 A1 12/1988
WO 1995013516 A1 5/1995
WO 1999018408 A1 4/1999
WO 2003036222 A1 5/2003
WO 2005022072 A2 3/2005
WO 2006094987 A1 9/2006
WO 2010129781 A1 11/2010
WO WO-2012047615 A1 * 4/2012 ..... F42B 5/30
WO 2012097317 A2 7/2012

(56) References Cited

FOREIGN PATENT DOCUMENTS

| | | | | |
|---|---|---|---|---|
| WO | 2012097320 | A1 | 7/2012 | |
| WO | 2013/016730 | A1 | 1/2013 | |
| WO | WO-2013096848 | A1 * | 6/2013 | ..... F42B 33/001 |

OTHER PUBLICATIONS

Chung, Jerry S., "Alternative Cartridge Case Material and Design", Armament Research, Development and Engineering Center Technical Report ARAEW-TR-05007, May 2005.

First Office Action dated Jul. 22, 2014, from corresponding Chinese Patent Application No. 201280015469.1.

First Office Action dated Aug. 15, 2014, from corresponding Chinese Patent Application No. 201280016748.X.

First Office Action dated Sep. 9, 2014, from corresponding Chinese Patent Application No. 201280016954.0.

First Office Action dated Oct. 31, 2014, from corresponding Chinese Patent Application No. 201280016930.5.

First Office Action dated Nov. 2, 2014, from corresponding Chinese Patent Application No. 201280016946.6.

First Office Action dated Dec. 1, 2014, from corresponding Chinese Patent Application No. 201980016948.5.

International Search Report and Written Opinion dated Oct. 4, 2019, from corresponding International Patent Application No. PCT/US2019/043743.

International Search Report and Written Opinion dated Oct. 4, 2019, from corresponding International Patent Application No. PCT/US2019/043617.

International Preliminary Report on Patentability and Written Opinion dated Feb. 2, 2021, from corresponding International Patent Application No. PCT/US2019/043617.

International Preliminary Report on Patentability and Written Opinion dated Feb. 2, 2021, from corresponding International Patent Application No. PCT/US2019/043728.

First Office Action dated Aug. 17, 2022, from corresponding Chinese Patent Application No. 201980051038.2.

Second Office Action dated Mar. 3, 2023, from corresponding Chinese Patent Application No. 201980051038.2.

* cited by examiner

FIG. 2C
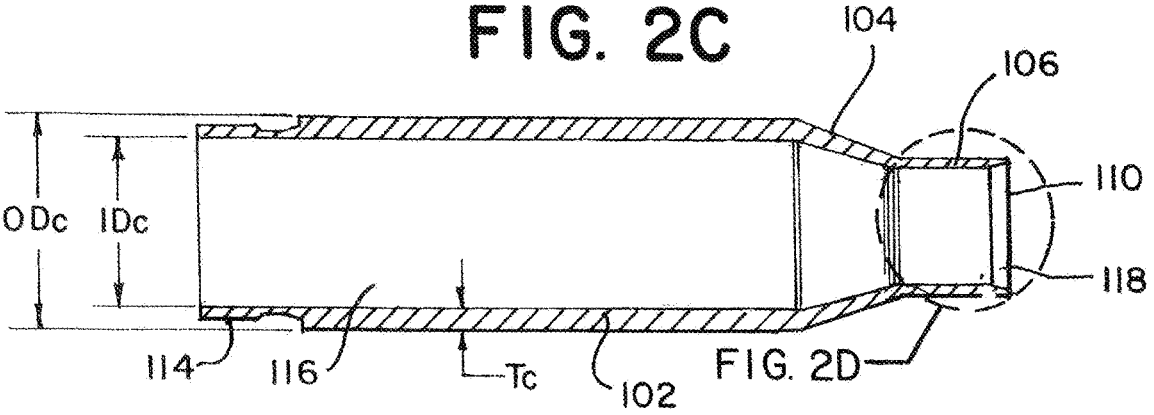
FIG. 2D
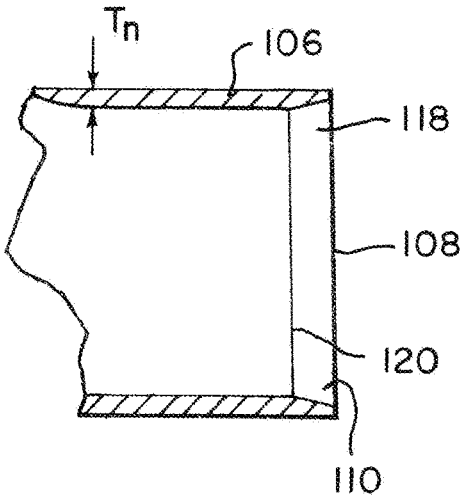
FIG. 3A
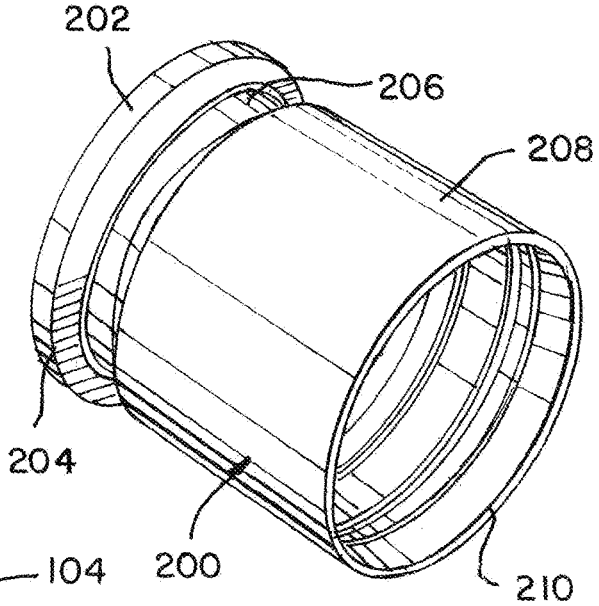
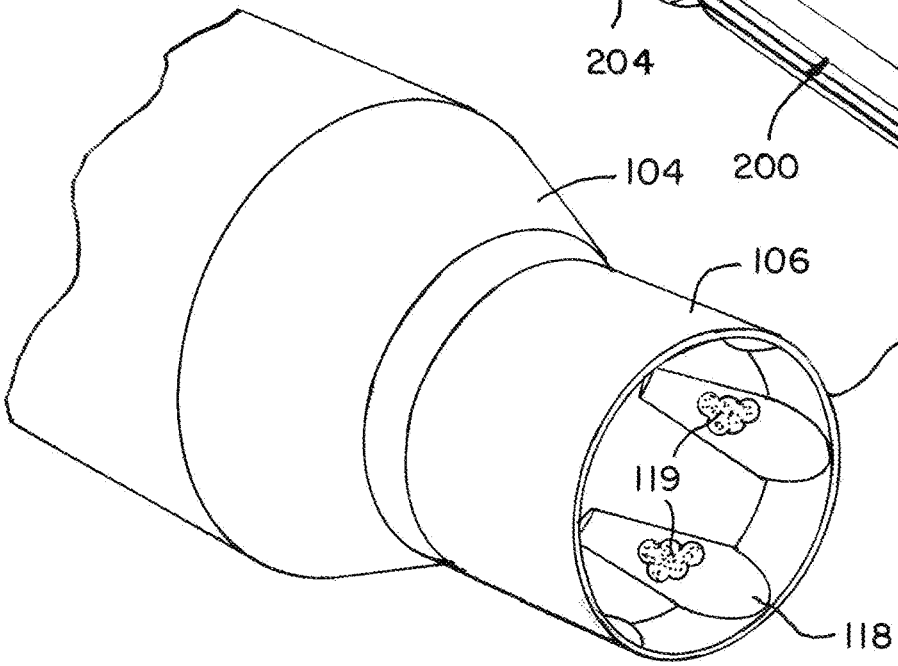
FIG. 2E

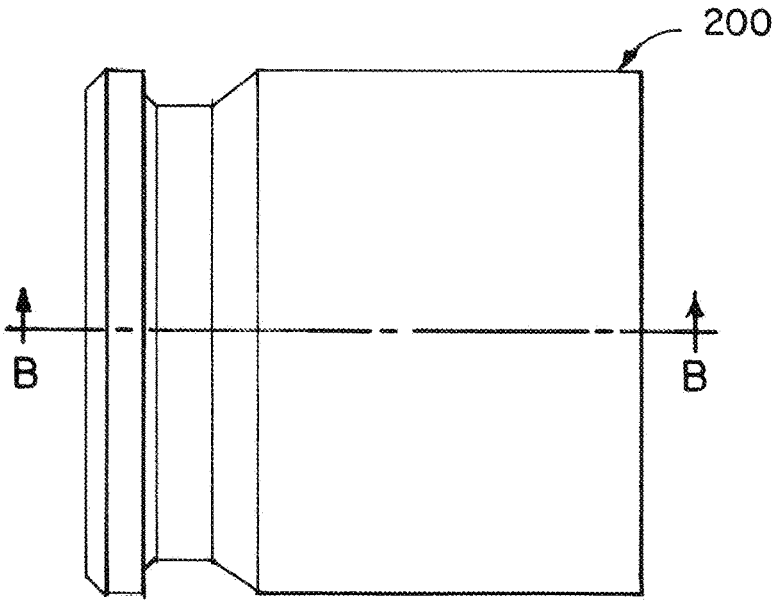
FIG. 6A
FIG. 6B
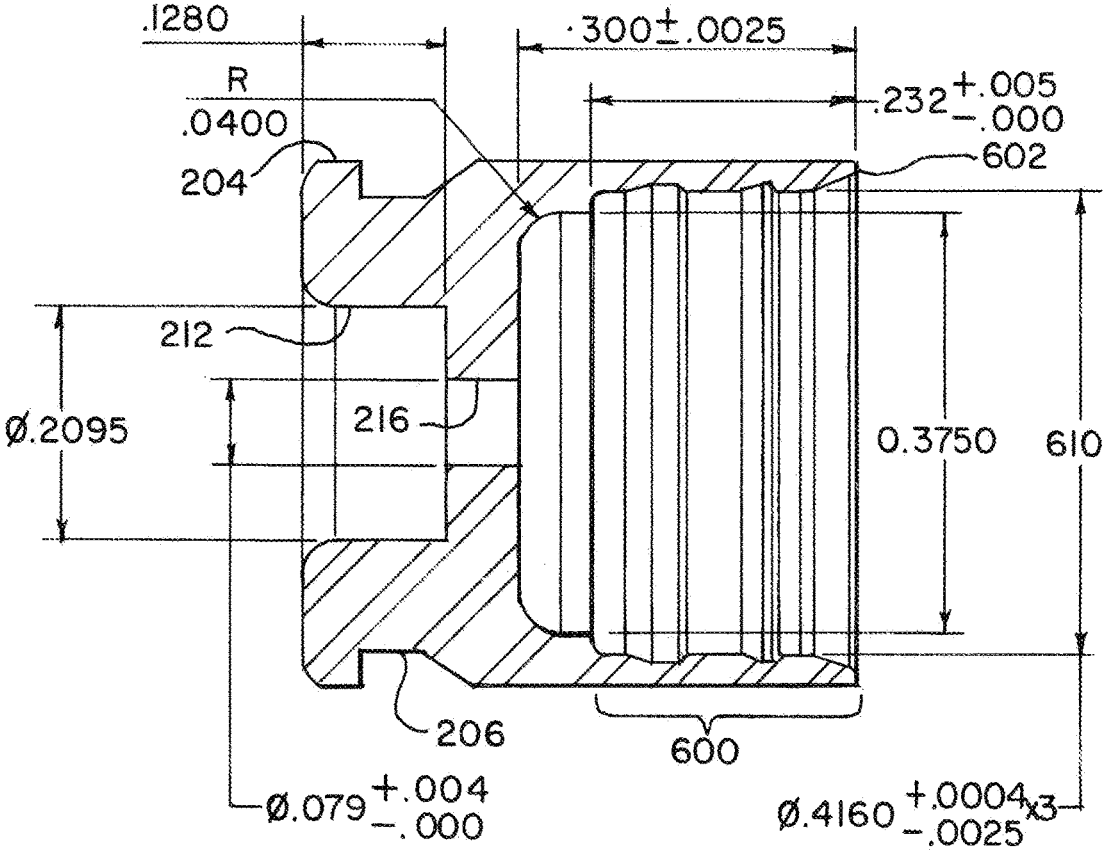

POLYMER AMMUNITION ARTICLE DESIGNED FOR USE ACROSS A WIDE TEMPERATURE RANGE

CROSS REFERENCE TO RELATED APPLICATIONS

The present application is a U.S. National Phase Application under 35 U.S.C. § 371 of International Patent Application No. PCT/US2019/043728 filed Jul. 26, 2019, which claims priority to U.S. Provisional Application 62/760,732 filed Nov. 13, 2018. The entire contents of which are incorporated herein by reference.

FIELD OF THE INVENTION

The present subject matter relates to ammunition articles with plastic components such as cartridge casing bodies, and, more particularly, a base insert used with the plastic cartridges.

BACKGROUND

It is well known in the industry to manufacture bullets and corresponding cartridge cases from either brass or steel. Typically, industry design calls for materials that are strong enough to withstand extreme operating pressures and which can be formed into a cartridge case to hold the bullet, while simultaneously resist rupturing during the firing process.

Conventional ammunition typically includes four basic components, that is, the projectile (bullet), a cartridge case, a propellant used to push the bullet down the barrel at predetermined velocities, and a primer, which provides the spark needed to ignite the powder which sets the bullet in motion down the barrel. The projectile, propellant and primer are all held in the cartridge case.

The cartridge case is typically formed from brass and is configured to hold the bullet therein to create a predetermined resistance, which is known in the industry as bullet pull. The cartridge case is also designed to contain the propellant media as well as the primer. However, brass is heavy, expensive, and potentially hazardous. For example, the weight of 0.50 caliber ammunition is about 60 pounds per box (200 cartridges plus links).

The cartridge case, which is typically metallic, acts as a payload delivery vessel and can have several body shapes and head configurations, depending on the caliber of the ammunition. Despite the different body shapes and head configurations, all cartridge cases have a feature used to guide the cartridge case, with a bullet held therein, into the chamber of the gun or firearm.

The primary objective of the cartridge case is to hold the bullet, primer, and propellant therein until the gun is fired. Upon firing of the gun, the cartridge case expands to seal the chamber to prevent the hot gases from escaping the chamber in a rearward direction and harming the shooter. The empty cartridge case is extracted manually or with the assistance of gas or recoil from the chamber once the gun is fired. Typically, the brass case has plastically deformed due to the high pressures leaving it larger than before it was fired.

One of the difficulties with polymer ammunition is having enough strength to withstand the pressures of the gases generated during firing. In some instances, the polymer may have the requisite strength, but be too brittle at cold temperatures, and/or too soft at very hot temperatures. Additionally, the spent cartridge is extracted at its base, and that portion must withstand the extraction forces generated from everything from a bolt action rifle to a machine gun. In bolt action weapons, the extraction forces are minimal due to the pressure having completely subsided prior to extraction and that extraction is performed by a manual operation of the shooter. Auto-loading semi-automatic and fully automatic weapons operate in a different manner where some of the energy of the firing event is utilized to extract the spent case and either load the next in a closed bolt design or ready the bolt to load the next round by storing potential energy in a spring mechanism in an open bolt weapon.

The extraction and ejection of the cartridge are both a part of this firing routine but are fundamentally different. Extraction deals with removing the spent casing from the chamber while ejection is the mechanism in which the spent case, once extracted, is removed from the weapon. Ejection is often accomplished with a spring in the bolt face which acts to propel the case in at an angle and direction to expel the casing. In other weapons systems, the case can be pushed out by a lever in the weapon that acts on the casing as it is being extracted rearward and provides a force that provides the required energy to expel the casing.

Since the base extraction point can be an area of failure, numerous concepts have developed to overcome the issues. Inventors like Daubenspeck, U.S. Pat. No. 3,099,958 have developed full metal inserts that are both overmolded (i.e. the polymer of the cartridge case is molded over the metal and undermolded (i.e. the polymer of the cartridge is molded inside the insert. This allows the insert to be added as part of the polymer molding process. Other references illustrate inserts that are added to the cartridge after it is formed. In these instances, the metal insert is either friction fit or screwed on to the back of the cartridge case. See, U.S. Pat. No. 8,240,252.

While these solutions may function for isolated rounds or within certain weapons there is no way to determine what type of molding or friction fit will function with all rounds and weapon systems across the wide range of temperatures needed for military class ammunition. Hence a need exists for a polymer casing that can perform as well as or better than the brass alternative. A further improvement is the base inserts joined to the polymer casings that are capable of withstanding all of the stresses and pressures associated with the loading, firing and extraction of the casing.

SUMMARY

Thus, the invention includes an ammunition article having a projectile (bullet), polymer cartridge case, metal base insert, propellant and primer. A metal base insert and polymer cartridge case remain joined together as a single piece assembly upon loading, firing and removal from a chamber of a firearm for a polymer case temperature of −65° F. (−54° C.) to 165° F. (74° C.).

The above article can be used in an M240 automatic rifle firearm and the metal base insert is joined to the polymer cartridge case such the single piece assembly prior to firing exhibits two more of the following mechanical properties:

- an axial pullout peak load greater than 150 lbf at −40° F. (−40° C.) as measured with an MTS universal test machine at a strain rate of 0.2 inches (5 mm) per minute;
- an axial pullout peak load greater than 175 lbf at 68° F. (20° C.) as measured with an MTS universal test machine at a strain rate of 0.2 inches (5 mm) per minute;

an axial pullout peak load greater than 150 lbf at 165° F. (74° C.) as measured with an MTS universal test machine at a strain rate of 0.2 inches (5 mm) per minute;

an axial pullout peak load ratio exceeding 0.90 as determined by the ratio of pullout peak load at 68° F. (20° C.) to the pullout peak load of 165° F. (74° C.) as measured with MTS universal test machine at a strain rate of 0.2 inches (5 mm) per minute;

a torsion cantilever maximum load greater than 32 lbf at −40° F. (−40° C.) as measured with an MTS universal test machine at a strain rate of 5 inches (127 mm) per minute;

a torsion cantilever maximum load greater than 35 lbf at 68° F. (20° C.) as measured with an MTS universal test machine at a strain rate of 5 inches (127 mm) per minute;

a torsion cantilever maximum load greater than 32 lbf at 165° F. (74° C.) as measured with an MTS universal test machine at a strain rate of 5 inches (127 mm) per minute; and/or an torsion cantilever maximum load ratio exceeding 0.90 as determined by the ratio of the torsion cantilever maximum load at 68° F. (20° C.) to the torsion cantilever maximum loads at 165 F (74 C) as measured with MTS universal test machine as a strain rate of 5 inches (127 mm) per minute.

Another example of a polymer ammunition article where an adhesive, sealant, epoxy or combination thereof is used to join, seal, bond or provide structural strength or toughness to prevent separation of the metal base insert and polymer cartridge case single piece assembly into two or more separate parts.

Another example where the metal base insert and polymer cartridge case assembly is absent of any adhesive, sealant, epoxy, gasket or o-ring. Also, the metal insert and polymer case can be joined together as a single piece assembly using a single, double or more snap fit features located on the metal base insert or polymer cartridge case or in combination thereof.

Further, the metal base insert and polymer cartridge case can be joined together as a single piece assembly using a snap fit, press fit, threads (screwing together), insert molding, over molding, heat staking, ultrasonic welding, spin welding, vibration welding, adhesive bonding, solvent bonding, mechanical crimping, mechanical fasteners or any combination thereof.

A polymer ammunition article used in a firearm where the firearm is not a M240, and the metal base insert is joined to a polymer cartridge case such the assembly prior to firing exhibits two or more of the following mechanical properties:

an axial pullout peak load greater than 65 lbf at −40° F. (−40° C.) as measured with an MTS universal test machine at a strain rate of 5 mm (0.2 inches) per minute;

an axial pullout peak load greater than 80 lbf at 68° F. (20° C.) as measured with an MTS universal test machine at a strain rate of 5 mm (0.2 inches) per minute;

an axial pullout peak load greater than 60 lbf at 165° F. (74° C.) as measured with an MTS universal test machine at strain rate of 5 mm (0.2 inches) per minute;

an axial pullout peak load ratio exceeding 1.25 as determined by the ratio of pullout peak load at 68° F. (20° C.) to the pullout peak load of 165° F. (74° C.) as measured with MTS universal test machine at a strain rate of 5 mm (0.2 inches) per minute;

a torsion cantilever maximum load greater than 25 lbf at −40° F. (−40° C.) as measured with an MTS universal test machine at a strain rate of 127 mm (5 inches) per minute;

a torsion cantilever maximum load greater than 20 lbf at 68° F. (20° C.) as measured with an MTS universal test machine at a strain rate of 127 mm (5 inches) per minute;

a torsion cantilever maximum load greater than 15 lbf at 165° F. (74° C.) as measured with an MTS universal test machine at a strain rate of 127 mm (5 inches) per minute; and/or a torsion cantilever maximum load ratio exceeding 1.25 as determined by the ratio of cantilever maximum load at 68° F. (20° C.) to the cantilever maximum load 165° F. (74° C.) as measured with MTS universal test machine at a strain rate of 127 mm (5 inches) per minute.

In examples an adhesive, sealant, epoxy or combination thereof is used to join, seal, bond or provide structural strength or toughness to prevent separation of the metal base insert and polymer cartridge case single piece assembly into two or more separate parts. In other examples, the metal insert and polymer case assembly does not have any adhesive, sealant, epoxy, gasket, or o-ring. Furthermore, the metal base insert and polymer cartridge case can be joined together as a single piece assembly using a single, double or more snap fit features located on the metal base insert or polymer cartridge case or in combination thereof.

In examples where the metal base insert and polymer cartridge case are joined together as a single piece assembly, a snap fit, press fit, threads (screwing together), insert molding, over molding, heat staking, ultrasonic welding, spin welding, vibration welding, adhesive bonding, solvent bonding, mechanical crimping, mechanical fasteners or any combination thereof can be used.

Examples can have the weight of the polymer cartridge case as more than 20 weight percent and/or less than 30 percent of the total weight of the single piece assembly. The polymer cartridge can contain a thermoplastic polymer, a polymer blend or mixtures thereof and may include homopolymers, copolymers or combinations thereof. Further examples of the polymer may include reinforcing glass fibers, plates, spheres or milled glass, mold release agents, flame retardants, ultra-violet stabilizers, thermo-oxidative stabilizers, antioxidants, impact modifiers, colorants, plasticizers, compatibilizers, minerals, nano-sized particles or combinations thereof.

The polymer cartridge case can include one or more hollow pieces formed, joined, bonded or fastened together into a single component. Examples can be produced by injection molding, compression molding, extrusion, blow molding, injection blow molding, stretch blow molding, thermoforming or any combination thereof. Examples of the metal base insert can be formed from one or more of the following metallic materials selected from stainless steel and/or pressure formed carbon steel. The carbon steel can be cold formed into shape. The carbon steel may for example be 1010 type ranging to 1035 type steel. In another example, heat treated carbon steel, 4140. The 4140 steel has a rating on the Rockwell "C" scale ("RC") hardness of about 20 to about 50. However, any carbon steel with similar properties, other metals, metal alloys or metal/non-metal alloys can be used to form the insert. Heat treating a lower cost steel alloy to improve its strength is a point of distinction from the prior art, which have typically opted for more expensive alloys to deal with the strength and ductility needed for a cartridge casing application.

The metal base insert can include one or more components joined together to form a single component. Examples include a metal-on-metal connection between the two components. This connection can be bonded (e.g., adhesives, welds, etc.) and/or mechanical (e.g., friction fit, snap, threading, interference fit, press fit, etc.) or any other metal-on-metal bonding known to those of ordinary skill. The metal base insert 200 can be produced, as above, by machining, milling, cold forming, turning, sintering, additive manufacturing, molding, etc.

In one example, the ammunition article can be reloaded, reused and fired in a firearm more than once. In other examples, the ammunition article can be made for a single use. The polymer can be chemically or physically weakened or altered to prevent reuse. In one example, the mouth of the ammunition article can be altered after firing to prevent another projectile from being seated in the article.

Other examples include the metal base insert joined to a polymer cartridge case in a single piece assembly. The assembly has a torsion cantilever maximum load after firing greater than the assembly before being fired, as measured at 68° F. (20° C.) with a MTS universal test machine at a strain rate of 127 mm (5 inches) per minute. Also, a free space can be present, (e.g. volume or voids) in the region of contact between the metal base insert and polymer cartridge case for which there is no material, adhesives, sealants, gaskets, or O-rings present.

BRIEF DESCRIPTION OF THE DRAWINGS

To the accomplishment of the foregoing and related ends, certain illustrative aspects are described herein in connection with the following description and the appended drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

The disclosure will be more clearly understood from the following description of some embodiments thereof, given by way of example only with reference to the accompanying drawings in which:

FIG. 2C is a cross-sectional view along line A-A of the cartridge body of FIG. 2B;

FIG. 2D is a magnified cross-sectional view of an example of the mouth of the cartridge body of the invention;

FIG. 2E is a magnified cross-sectional view of an example of a scalloped mouth of the cartridge body of the invention;

FIG. 3A is a perspective view of the body insert in accordance with an example of the invention;

FIG. 6A is a side view of the body insert in accordance with an example of the invention;

FIG. 6B is a cross-sectional view along line B-B of the cartridge body of FIG. 6A;

DETAILED DESCRIPTION

Figure 1:
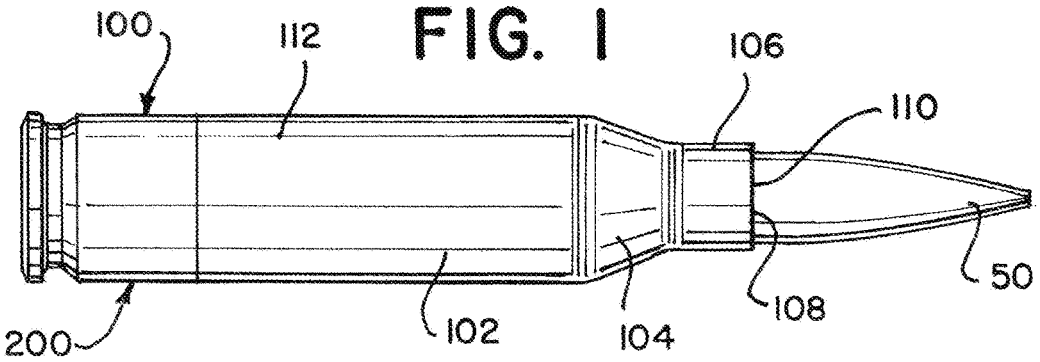
FIG. 1 is a side elevation sectional view of a bullet and cartridge in accordance with an example of the invention.

Although example embodiments of the present disclosure are explained in detail herein, it is to be understood that other embodiments are contemplated. Accordingly, it is not intended that the present disclosure be limited in its scope to the details of construction and arrangement of components set forth in the following description or illustrated in the drawings. The present disclosure is capable of other embodiments and of being practiced or carried out in various ways.

The definitions below are known to those of skill in the art, are not exclusive, but set forth for a common understanding of the terms.

"Adhesive" can be defined to include five adhesive types: epoxy, urethane, anaerobic, cyanoacrylate and acrylic. This includes any and all required primers and processes required for curing such as UV exposure or heat treatments.

"Ammunition Article" can be defined as consisting of the following parts: 1) projectile (bullet), 2) cartridge case, 3) propellant and 4) primer. The cartridge case holds projectile as well as propellant and primer.

"Assembly" is defined as a single piece for which the metal insert and polymer cartridge case are joined together and excludes the presence of an adhesive, sealant or bonding agent. In the simplest terms, it consists of two parts, a polymer cartridge case and a metal base insert.

"Conventional Ammunition Article" can be an ammunition article, metallic (e.g. brass) in construction.

"Polymer Ammunition Article" can be defined as a fully assembled ammunition article ready to be fired. It consists of a cartridge case made with a 1) polymer cartridge case and 2) metal base insert. The polymer cartridge case holds the projectile as well as the propellant with the primer located in the metal base insert. The overall construction typically consists of five separate components as compared to four components in a conventional ammunition article.

"Removal" can be defined to include the ejection, extraction or any act or sequence of events that cause the spent/fired polymer ammunition article to be expelled, discharged or cleared from the firearm so another polymer ammunition article may be loaded.

"Sealant" can be defined as a substance used to block the passage of fluids through the joints or openings in polymer ammunition article, notably between the cartridge and base. A sealant includes at least chemical and mechanical seals. A seal can be further formed in the polymer itself as a molded in feature using polymers with different melting points and durometer.

Referring now to FIG. 1, an example of a cartridge 100 for a polymer ammunition article has a cartridge case 102 which transitions into a shoulder 104 that tapers into a neck 106 having a mouth 108 at a first end 110. The mouth 108 can be releasably connected to, in a conventional fashion, to a bullet or other weapon projectile 50. The cartridge case can be made from a plastic material, for example a suitable polymer. The rear end 112 of the cartridge case is connected to a base 200.

Figure 2A:
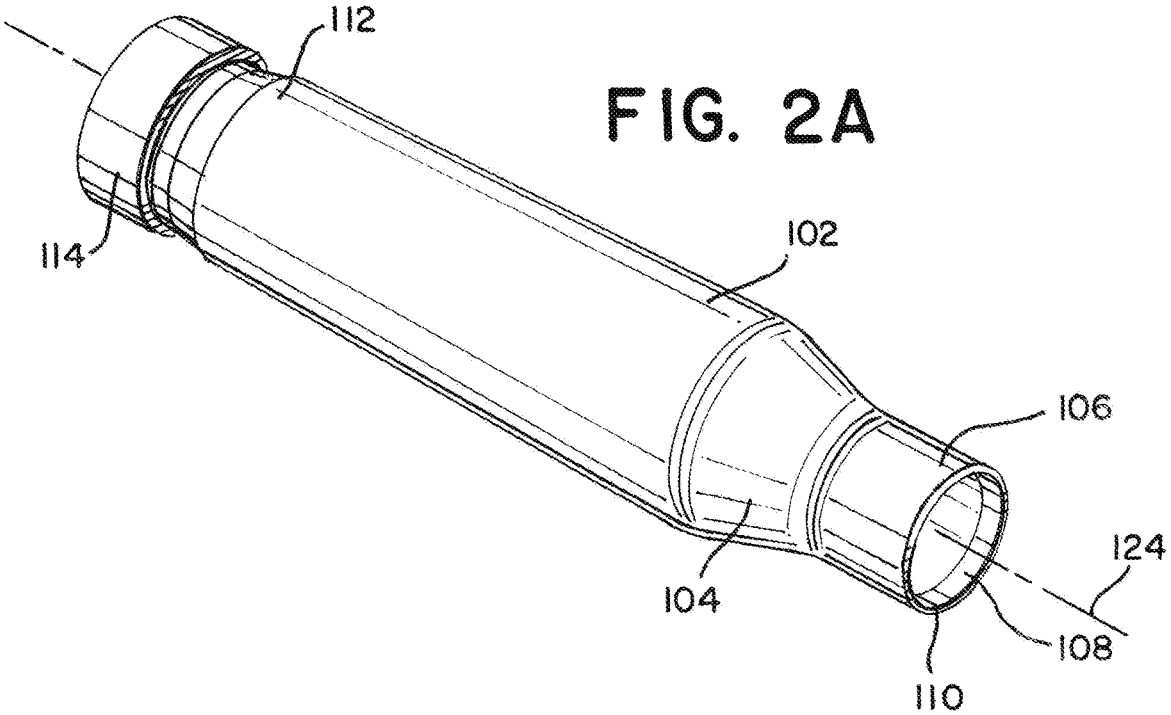
FIG. 2A is a perspective view of the cartridge body in accordance with an example of the invention.
Figure 2B:
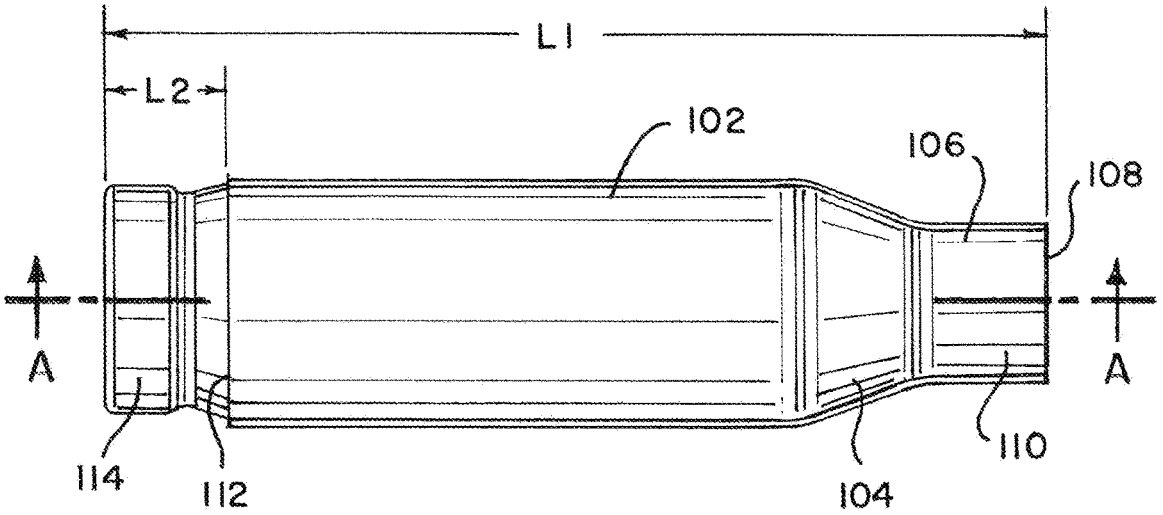
FIG. 2B is a side view of the cartridge body of FIG. 2A.

FIGS. 2A-2C illustrate the cartridge case 102 without the projectile 50 or base 200. FIGS. 2A-2C illustrate the base interface portion 114 positioned at the rear end 112 which provides the contact surface with the base insert 200. This is described in detail below. FIG. 2B illustrates that the case 102 from the front of the front end 110 to the rear of the rear end 112 has a length L1. The base interface portion 114 has a length L2.

FIG. 2C illustrates a cross-section of the case 102 along line A-A. Here, the majority of the case 102 forms a propellant chamber 116. The propellant is typically a solid chemical compound in powder form commonly referred to as smokeless powder. Propellants are selected such that when confined within the cartridge case 100, the propellant burns at a known and predictably rapid rate to produce the desired expanding gases. The expanding gases of the propellant provide the energy force that launches the bullet from the grasp of the cartridge case and propels the bullet down the barrel of the gun at a known and relatively high velocity. The volume of the propellant chamber 116 determines the amount of powder, which is a major factor in determining the velocity of the projectile 50 after the cartridge 100 is fired. The volume of the propellant chamber 116 can be decreased by increasing a case wall thickness Tc or adding a filler (not illustrated). The type of powder and the weight of the projectile 50 are other factors in determining projectile velocity. The velocity can then be set to move the projectile at subsonic or supersonic speeds.

FIG. 2D is a magnified cross-section of the neck 106 and mouth 108. The neck 106 can have a thickness Tn. In this example, at the mouth 108 is a relief 118. The relief 118 is a recess cut into the neck 106 proximate the front of the front end 110. The relief 118 can be used to facilitate the use of an adhesive 119 to seat the bullet 50. Even if the bullet 50 seats tightly in the neck 106, certain types of ammunition can be made waterproof. Waterproofing the article can include using a waterproof adhesive 119 between the bullet 50 and the mouth 108/neck 106. The relief 118 allows a gap between the bullet 50 and the neck 106 for the adhesive 119 to pool and set to make a tight, waterproof seal. The adhesive 119 also increases the amount of tension necessary to remove the bullet 50 from the mouth 108 of the casing. The increase in both required push and pull force helps keep the bullet 50 from dislodging prior to being fired. Alternatively, adjusting the pre-insertion inner diameter of the mouth 108 of the case 100 can be decreased to increase the amount of push and pull force to remove the bullet 50 with limitations. As polymers are stressed and aged, a phenomenon known as creep occurs, which allows for permeant deformations and reduction in the stress. This phenomenon has the tendency to reduce the neck tension over time thus providing additional need for the adhesive 119 to retain the projectile 50.

The relief 118 can be formed as a thinner wall section of the neck 106. It can be tapered or straight walled. If the relief 118 is tapered, the inner diameter will increase in degrees as it moves from the mouth 108 down the neck 106. Alternately, the relief 118 can be stair stepped, scalloped (see FIG. 2E), or straight walled and ending in a shelf 120. Additionally, an example of the adhesive 119 can be a flash cure adhesive that cures under ultraviolet (UV) light. Further, once cured, the adhesive 119 can fluoresce under UV in the visual spectrum to allow for visual inspection. Additional flash cure adhesives 119 can fluoresce outside the visual spectrum but be detected with imaging equipment tuned to that wavelength or wavelength band.

Figure 3B:
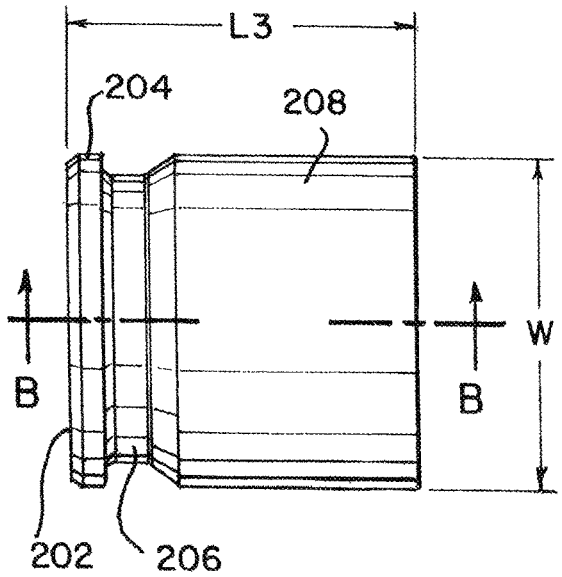
FIG. 3B is a side view of the body insert of FIG. 3A.
Figure 3C:
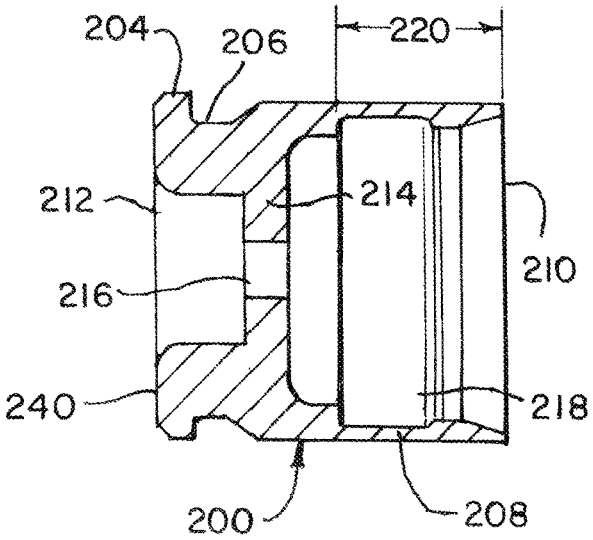
FIG. 3C is a cross-sectional view along line B-B of the cartridge body of FIG. 3B.

FIGS. 3A-3C illustrate the base/insert 200 separate from the cartridge case 102 and the projectile 50. The base 200 has a rear end 202 with an enlarged extraction lip 204 and groove 206 just in front to allow extraction of the base 200 and cartridge 100 in a conventional fashion. An annular cylindrical wall 208 extends forward from the rear end 202 to the front end 210. FIG. 3C illustrates a primer cavity 212 located at the rear end 202 and extends to a radially inwardly extending ledge 214 axially positioned intermediate the rear end 202 and front end 210. A reduced diameter passage 216, also known as a flash hole, passes through the ledge 214. The cylindrical wall 208 defines an open ended main cavity 218 from the ledge 214 to open front end 210. The primer cavity 212 and flash hole 216 are dimensioned to provide enough structural steel at annular wall 208 and ledge 214 to withstand any explosive pressures outside of the gun barrel.

FIG. 3B illustrates the base length L3 from rear to front ends 202, 210. As will be described, only a portion of the base length L3 of the insert 200 engages with the base interface portion 114 along its length L2. The case interface portion 220 is shaped to interface with the case's 102 base interface portion 114. The case 102 and the base 200 are "snapped", friction fit, or interference fit together. Said another way, the insert 200 and the body 102 can be interlocked. This can occur before or after both pieces are formed. FIG. 3B illustrates an interlocking design which can have the polymer base interface portion 114 "inside" the insert 200, i.e. the portion defined by length L2, and at that only the insert wall 208 is exposed. The insert 200, in this example, is not overmolded. Thus, the width W, or outer diameter, of the insert 200 approximately matches an outer diameter of the case 102 at that point (i.e., ODc) once assembled. The present invention includes a slightly oversized polymer body such that when the metal case expands during firing, that the polymer portion maintains its interlock.

Figure 4:
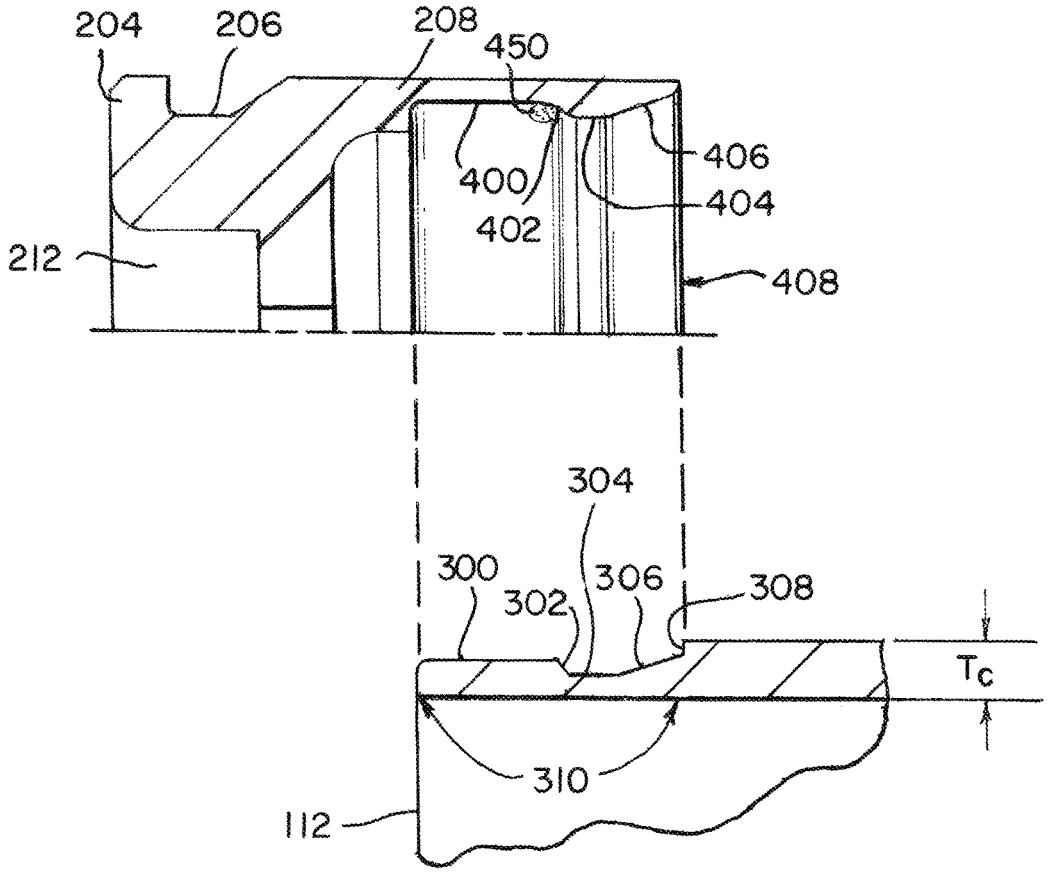
FIG. 4 is a magnified, exploded, cross-section view of the base interface portion and the case interface portion.

FIG. 4 illustrates an exploded magnified view of an example of a single annular snap for the case interface portion 220 and the base interface portion 114. Turning first to an example of the base interface portion 114, there is the flat portion 300 followed by a first slope 302. The base interface portion 114 then straightens out to dip 304 followed by a second slope 306, which can end in edge 308 before meeting the main wall of the case 102. These elements are an example of a singular annular case snap 310. As noted above, the case wall thickness Tc is the thickness of the wall and the outside of the wall forms the outer diameter of the entire cartridge 100. Thus, the wall thicknesses of the base interface portion 114 must be less than the case wall thickness Tc so when the base 200 is fit on, its wall 208 approximately matches the diameter of the cartridge 100.

The features on the case interface portion 220 generally mirror those on the base interface portion 114 so the two can connect. The insert 200 can have a flat section 400 leading to a first incline 402. At the end of the first incline 402 is a bulge 404 which is generally flat until the second incline 406 which then can end in a vertical tip 408. These features 400, 402, 404, 406, 408 in metal, particularly the first incline 402 and the bulge 404 can be used to keep the base 200 on the case 102. This is an example of an insert single annular snap 410. The angle of 402 is important such that the angle must be steep enough to restrain the two components from separating. The present invention has a 60° angle, though a minimum of a 45° angle on feature 402 up to a maximum of 90° is possible. The combination of the single annular case snap 310 and the insert first annular snap 410 assembles the rear end 112 of the cartridge 100.

However, the reduced wall thicknesses of the base interface portion 114 can be points of failure since the polymer is the thinnest where most stresses occur during ejection of the round 100 after firing. Metal inserts, whether molded or friction fit, can fail in at least two ways. The two common ways are "pull-off" and "break-off." In a pull-off failure, the metal insert is pulled away from the polymer cartridge during extraction, thus the base is ejected, but the reminder of the cartridge remains in the chamber. The polymer is not damaged, just the bond between the metal and polymer failed and the base "slipped" off. In break-off failure, the polymer is broken, typically at the thinnest point, and the insert, along with some polymer, are ejected. Pull-off failure can occur in any type cartridge, while break-off failure is less common in reduced capacity polymer cartridges. Reduced capacity, e.g. subsonic polymer rounds, are already thickening the walls inside the cartridge, and can alleviate this issue. Break-off primarily occurs in supersonic or standard rounds where maximum capacity is an important factor and the wall thickness Tc is at its minimum.

There can be a relationship between the angle of the first incline 402, insert 400 "hold" force and stress concentrating at that particular point. The smaller the angle of the first incline 402 the insert 400 has more movement or "wiggle room". This lowers the amount of stress that can be concentrated at point on the cartridge body. However, this weakens the pull resistance and the insert 400 is more likely to be pulled off during extraction. In contrast, as the angle of the first incline 402 increases, the more fixed the insert 400 is to the body, thus having greater pull-off strength. However, this now increases the amount of localized stress that is applied to the body by the insert. Thus, as the angle increases, the likelihood of break-off failure increases.

The above is an example of a single annular snap design where the base 200 and the case 102 can be friction fit together and withstand the forces necessary during loading, firing, and extraction of the cartridge 100. The fit can be made with or without added adhesive/sealant 450 at the rear 112 of the case 102 required.

This friction fit can also typically water resistant. However, additional adhesion or water proofing may be required for certain uses. In one example of the present invention, a sealant 450 is applied only to the first incline 402 before the base 200 and case 102 are assembled. The sealant 450 can then be smeared under pressure along the flat portion/section 300, 400. This keeps the metal/polymer interface friction fit.

Figure 5A:
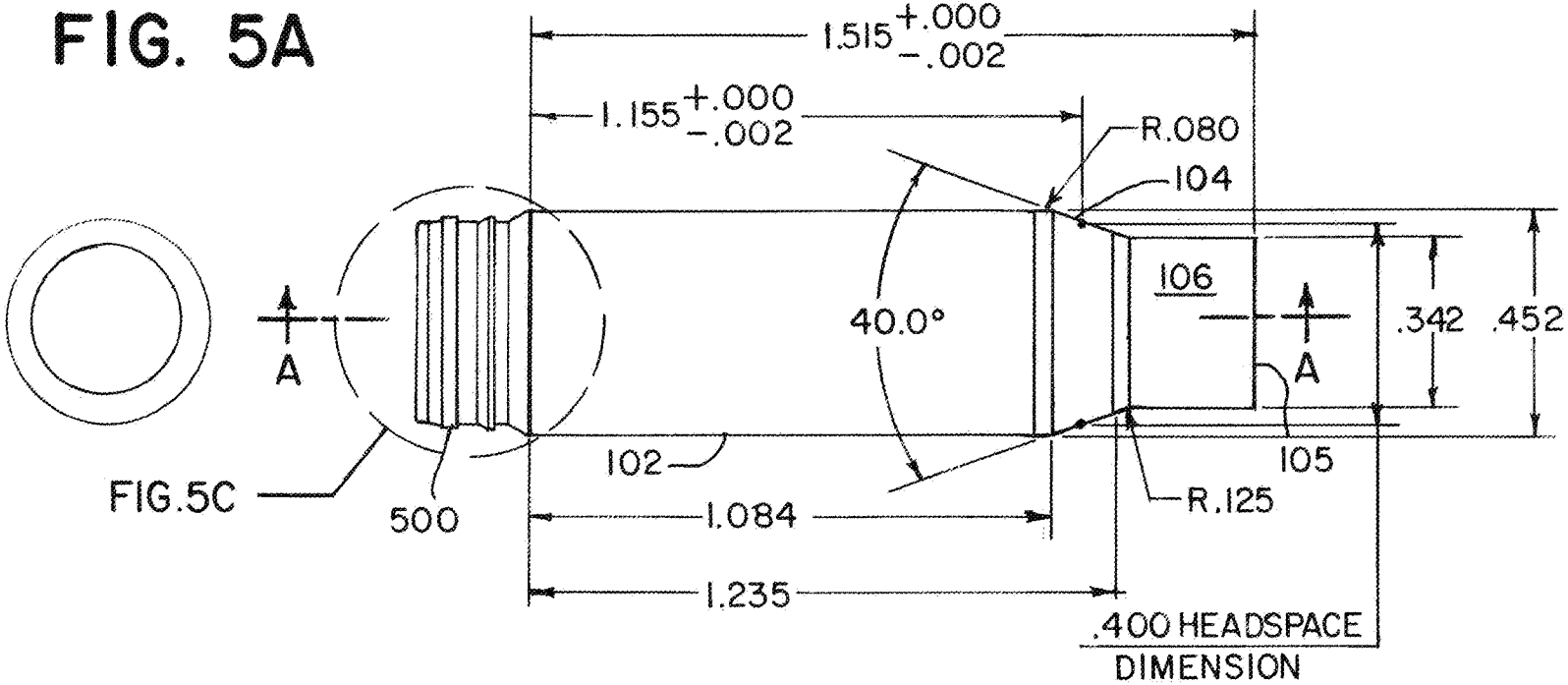
FIG. 5A is a side view of the cartridge body in accordance with an example of the invention.
Figure 5B:
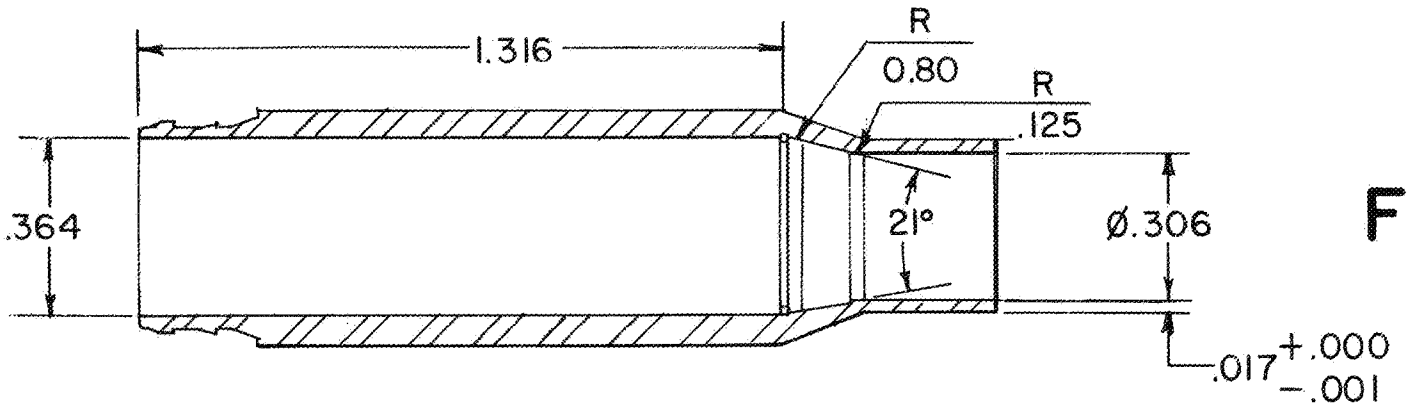
FIG. 5B is a cross-sectional view along line A-A of the cartridge body of FIG. 5A.
Figure 5C:
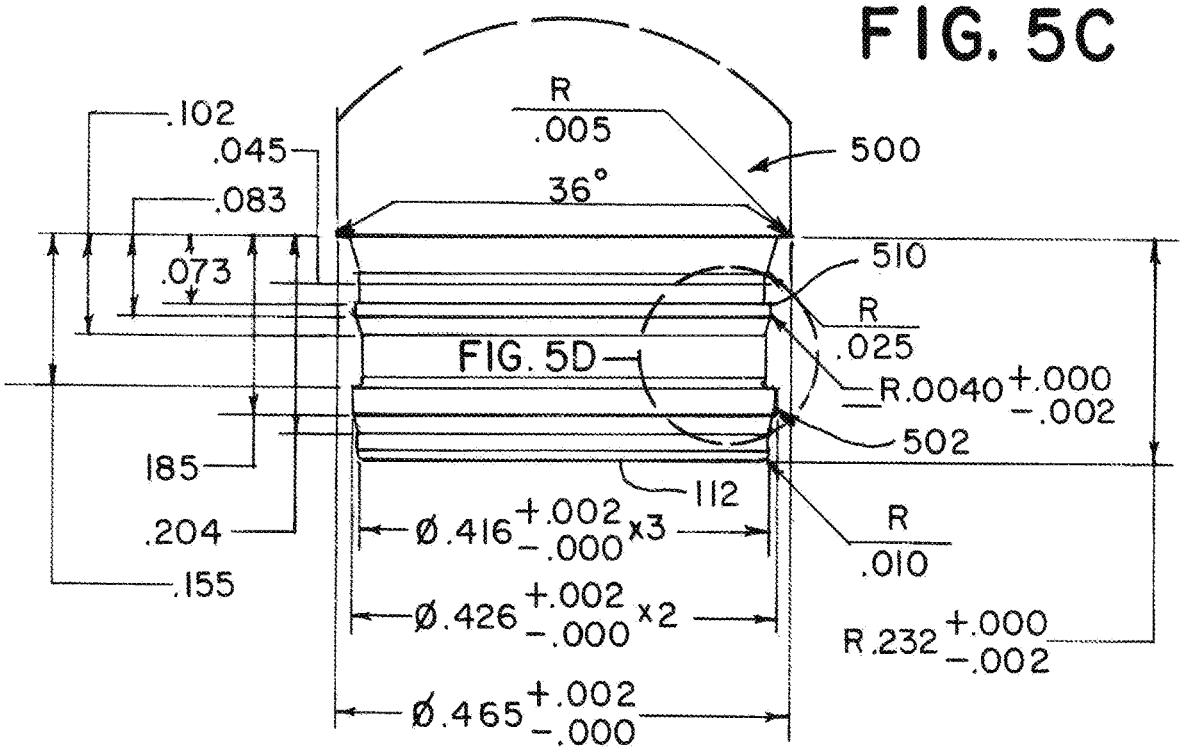
FIG. 5C is a magnified cross-sectional view of an example of the snap-fit region of the cartridge body of the invention.
Figure 5D:
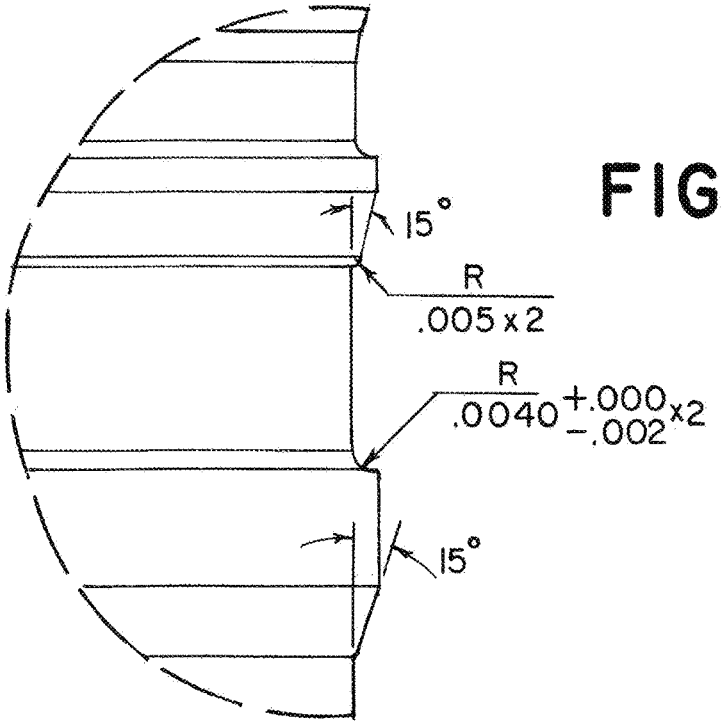
FIG. 5D is a magnified view of the body snap-fit region.

FIGS. 5A-5D illustrate another example of the cartridge case 102 without the projectile 50 or insert 200. This example is a double annular snap. FIGS. 5A, 5C, and 5D illustrate another example of a body snap-fit region 500 positioned at the rear end 112 which provides the contact surface with the base insert 200. This is described in detail below. FIG. 5B illustrates a cross-section of the case 102 along line A-A. Here, the majority of the case 102 forms a propellant chamber 116, as discussed above.

The double body snap-fit region 500 on the rear end 112 of the case 102 has two sets of ridges 502, 510 to engage the insert 200. As opposed to a single snap-fit/interface region 310, 410, this example of the double annular body snap-fit region 500 can absorb additional torque that certain weapons produce in their cartridge ejection systems. For example, the M240 machine gun's ejection system applies approximately 5 times the ejection force of an AR style semi-automatic rifle and can over torque the insert 200 when extracting the cartridge 100, leading to the insert 200 being pulled from the body 102, leading to jamming. This additional torque produced by the ejector can cause the case to flex during extraction. This flex can lead to jamming of the firearm.

This example of the double annular snap of the present invention now can include a lower snap ridge 502 proximate the second end 112 in combination with an upper snap ridge 510, both formed on the polymer body 102. The lower snap ridge 502 has a lower snap length 504. This length 504 is measured along a vertical axis 124 of the cartridge 100 (see FIG. 2A). This is formed closest to the rear end 112 of the body 102 and its position and dimensions can be modified for each particular size cartridge based on at least the caliber of the projection 50 being fired. A lower snap first edge 506 can be proximal the second end 112 and can be sloped. This slope can be approximately 15° and can facilitate the insert 200 being slid onto the body 102. A lower snap second edge 508 can be farther from the second end 112 than the lower snap first edge 506, i.e. the other edge of the ridge 502. The lower snap second edge 508, in examples can be sharp, and can be set at approximately at 90°. Setting this edge 508 at a sharp angle provides additional strength however, the trade-off is that more localized stress can occur at the snap. This was accommodated for by adding a second snap which divides the stress between to two points and over a longer distance.

The second snap-fit, or interference, region is an upper snap ridge 510 closer to the first end 110 than the lower snap ridge 502. The upper snap ridge 510 has an upper snap length 512 shorter than the lower snap length 504 (e.g., 504>512). Also, as with the lower snap region 502, an upper snap first edge 514 can be proximal the second end 112 and can have a slope which can be approximately 15°. An upper snap second edge 516 farther from the second end 112 than the upper snap first edge 514 can be sharp as well. In some examples, be set at approximately 90°.

As with the previous examples, the insert double annular snap-fit region 600 can be dimensioned to mirror the double annular body snap fit region 500. As the first (upper) set of snap-fit regions 510, 514, 516 start to pass over each other, the smaller-in-length upper regions 510, 514, 516 cannot engage with the larger-in length lower regions 502, 506, 508, preventing the insert 200 from being "half-snapped". Additionally, the use of approximately 90° edges 508, 516 provides to a more positive engagement between the body and insert snap regions 500, 600.

Figure 6C:
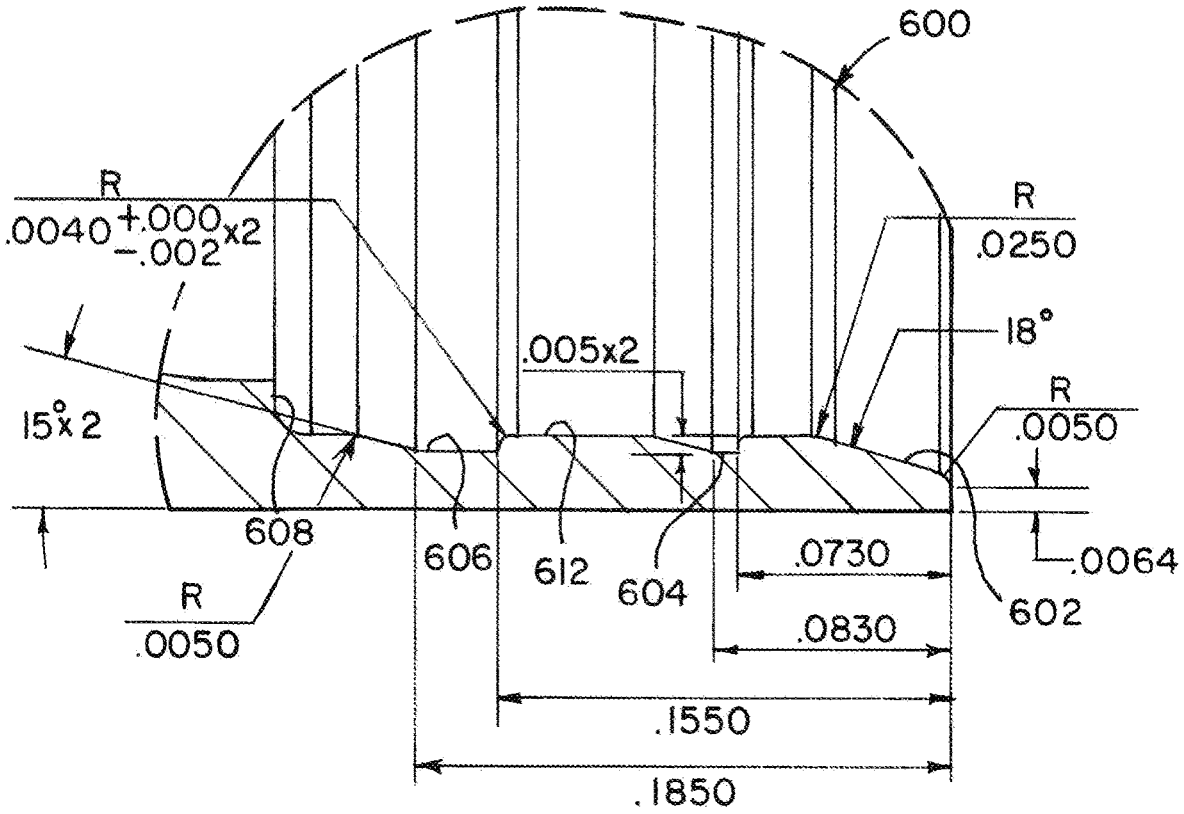
FIG. 6C is a magnified cross-sectional view of an example of the insert snap-fit region of the cartridge body of the invention.
Figure 7:
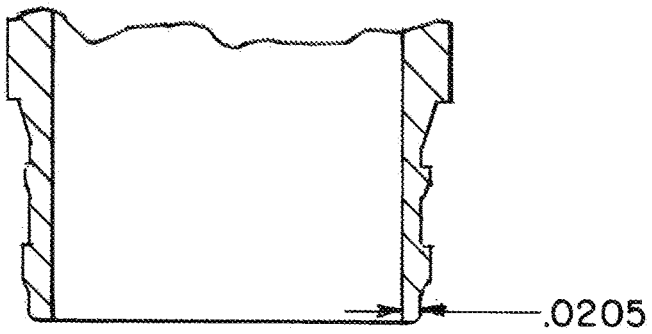
FIG. 7 is a magnified cross-section view of the body snap-fit region.

Turning now to FIGS. 6A-6C, the insert 200 can have an insert double snap-fit region 600 with a leading edge 602 opposite the rim 206. The leading edge 602 can be sloped, radiused, or both. This slope can be approximately 18°, in one example. The sloped leading edge 602 can smooth the initial transition as the insert 200 is fit onto the body 102. The leading edge 602, once the insert 200 is fully engaged with the body 102, can act as a failure point since the metal edge can "dig" into the polymer body if moved out of plane. Rounding the edge of the leading edge 602 can lower that stress. An insert upper recess 604 can be approximately dimensioned to receive the upper snap-fit region 510, 512, 514, 516 and an insert lower recess 606 can be approximately dimensioned to receive the lower snap-fit region 502, 504, 506, 508. Once the body and insert regions engage, the insert 200 is snapped-on and the cartridge 100 can be loaded with powder and projectile 50 and discharged.

The insert 200 can further include a shoulder 608 disposed between the flash hole 216 and the insert snap fit region 600 that can contact the polymer case second end 112. Again, this minimizes the edge contact that can be stress points.

In one example, the double annular body snap-fit region 500 has a body snap-fit diameter 518 and the insert snap-fit region 600 has an insert snap-fit diameter 610 approximately less than the body snap-fit diameter 518. Since the insert snap-fit region 600 engages over the body snap-fit region 500, this means that, in one example an average inner diameter 610 of the insert snap-fit region 600 is smaller than an average outer diameter 518 of the body snap fit region 500. In different examples, the diameters can be taken from the smallest point, the largest point, or an average over some or all of the regions 500, 600. The body snap-fit diameter 518 and the insert snap-fit diameter 610 can both be taken from the same points (e.g., both from the smallest point) or differing points depending on the design and caliber. Said differently, the case 102 can be pre-loaded in compression thus allowing for permanent plastic expansion of the metal insert 200 during firing while keeping the mechanical, interference lock from disengaging.

The above mechanical designs were used to then construct polymer ammunition articles 100 for evaluation. The following materials presented in Table 1 were used to construct the polymer ammunition articles to be evaluated in a firearm. The polymer case testing temperatures ranged from −65° F. (−54° C.) to 165° F. (74° C.). The design and materials were used in support of examples 1 thru 11, further described below.

The following paragraph describes how material properties of the thermoplastic resins used in injection molding of the polymer cartridge case were determined. A 180-ton injection molding machine with a 5.25 oz. barrel was used to mold ASTM test samples for evaluation of tensile, flexural and heat deflection temperature properties. The thermoplastic materials were molded with a melt temperature of 305° C. after 8 hours of drying in a dehumidifying dryer at 125° C. to a moisture level less than 0.02 wt %. A thermolator was used to control the mold surface temperature to 85° C. Screw rotation ranged from 60-80 rpm with 0.3 MPa back pressure without screw decompression after screw recovery. A typical cycle time of 30-32 seconds resulted and was dependent on the ASTM test specimen molded. Tensile properties were evaluated using an ASTM D 638 standard test method with a Type I test specimen at a thickness of 0.125 inch (3.18 mm) and rate of 2.0 in/min (50 mm/min.). Flexural properties were measured using ASTM D 790 standard test method with a 0.125 inch (3.18 mm) thickness test specimen and rate of 0.05 inch/min (1.27 mm/min). The heat deflection temperature was measured using ASTM D 648 standard test method with 264 psi (1.8 MPa) and 0.125 inch (3.18 mm) thick unannealed test sample. All molded samples were conditioned for at least 48 hours at 23° C. and 50+/−5% relative humidity (RH) prior to testing.

Acrylic and cyanoacrylate adhesives were used in the proceeding examples with a single piece assembly, which comprised of a polymer cartridge case and metal base insert joined together using either the single 310 or a double 410 annular snap fit. The adhesives 450 varied in composition, shear strength, temperature operating range, cure time and viscosity to report a few differences described by their respective suppliers. Several additional characteristics of each type are also listed by the material supplier and are presented in Table 1 for review. Teroson loctite 5570 WH acrylic sealant is characterized as having the lowest shear strength of the adhesives evaluated and provided little bonding strength beyond creating a seal between the polymer cartridge case and metal base insert. In contrast, ethyl and alkoxy cyanoacrylates provide significantly higher shear strength and higher temperature capabilities than the sealant and are supplied by Loctite in the form of products designated as 408 and 411. In addition, an impact toughened ethyl cyanoacrylate supplied by the Gorilla Glue Company as a

TABLE 1

Materials

| Name | Type | Material Description |
|---|---|---|
| Amorphous Polymer | Resin | Thermoplastic amorphous polymer blend with tensile yield strength of 8.2 kpsi (56 MPa), flexural modulus of 315 kpsi (2170 MPa) and heat deflection temperature of 125° C. (257° F.). The material was supplied by SABIC. |
| GF Amorphous Polymer | Resin | Milled glass filled thermoplastic amorphous polymer blend at 7 weight percent based on total weight. Tensile yield strength of 8.4 kpsi (58 MPa), flexural modulus of 330 kpsi (2274 MPa) and heat deflection temperature of 125° C. (257° F.). The material was supplied by SABIC. |
| Acrylic | Sealant | Teroson Loctite 5570 WH acrylic solvent free sealant, 7 day cure, shear strength: 400 psi (2.8 MPa), temperature range: −22° F. to 176° F. (−30° C. to 80° C.). |
| Ethyl Cyanoacrylate (#1) | Adhesive | Gorilla Super Glue Impact Tough, ethyl cyanoacrylate, 24 hour cure, temperature range: −65° F. to 220° F. (−54° C. to 104° C.). Supplied by Gorilla Glue Company. |
| Alkoxy Cyanoacrylate | Adhesive | Loctite 408 alkoxy cyanoacrylate, 24 hour cure, shear strength: 2600 psi (17.9 MPa), temperature range: −65° F. to 200° F. (−54° C. to 93° C.). |
| Ethyl Cyanoacrylate (#2) | Adhesive | Loctite 411 ethyl cyanoacrylate, 24 hour cure, shear strength: 3200 psi (22 MPa), temperature range: −65° F. to 210° F. (−54° C. to 99° C.). |
| 303 | Metal | AISI Type 303 non-magnetic austenitic stainless steel. Specially designed to exhibit improved machinability while maintaining good mechanical and corrosion resistant properties. Yield strength of 60 kpsi (415 Mpa). |
| 17-4 | Metal | 17-4 PH chromium-copper precipitation hardened stainless steel with high strength and moderate level of corrosion resistance. Yield strength of 180 kpsi (1240 Mpa). |

The materials for the polymer ammunition article are above and described in more details below. The thermoplastic amorphous resins used in the examples are listed in Table 1 with mechanical and thermal properties briefly described. The thermoplastic resins were supplied by SABIC and consisted of an unfilled material as well as a 7.0 wt. % glass filled material based on the total weight of the blended resin. The glass-filled material was produced by blending milled glass with the unfilled resin and compounding the materials together in a single screw extruder to form pellets of uniform composition. The filled and unfilled resins were injection molded into ASTM test specimens and into polymer cartridge cases for testing using procedures detailed in the following paragraphs.

super glue was used in the examples as an impact toughened adhesive. The adhesives were applied directly to the metal base insert prior to joining with the polymer cartridge case and allowed to cure under the conditions recommended by the respective material supplier.

Metal base inserts were machined from bar stock supplied by EMJ Metals into final net shape form and consisted of two different types of stainless steel materials. Metal alloy 17-PH and AISI 303 stainless steel varied in yield strength and their machinability among other mechanical, thermal and physical properties. The 17-PH alloy is characterized as a chromium-copper precipitation hardened stainless steel with a moderate level of corrosion resistance and yield strength of 180 kpsi (1240 Mpa). The AISI 303 non-magnetic austenitic stainless steel exhibits improved machinability while maintaining good mechanical and corrosion resistant properties. The yield strength is 60 kpsi (415 Mpa) which was significantly lower than 17-PH alloy used in the examples. The two metals represent significantly different types of metals for evaluation and are included in the inventive examples.

EXAMPLES

Examples of the invention are designated by numbers whereas letters designate comparative control samples as shown in Table 2.

TABLE 2

.308 Caliber Ammunition Article

| Name | Description | Polymer Type | Metal Type | Sealant | Adhesive |
|---|---|---|---|---|---|
| Sample A (Comparative) | Single annular snap of metal base insert to polymer cartridge case | Amorphous Thermoplastic | 303 | None | None |
| Sample B (Comparative) | Brass conventional ammunition article of .308 caliber | None | None | None | None |
| Sample 1 (Invention) | Single annular snap of metal base insert to polymer cartridge case | Amorphous Thermoplastic | 303 | Acrylic | None |
| Sample 2 (Invention) | Single annular snap of metal base insert to polymer cartridge case | Amorphous Thermoplastic | 17-4 | None | Ethyl Cyanoacrylate (#1) |
| Sample 3 (Invention) | Single annular snap of metal base insert to polymer cartridge case | Glass Filled Amorphous Thermoplastic | 17-4 | None | Ethyl Cyanoacrylate (#1) |
| Sample 4 (Invention) | Double annular snap of metal base insert to polymer cartridge case | Amorphous Thermoplastic | 303 | None | None |
| Sample 5 (Invention) | Double annular snap of metal base insert to polymer cartridge case | Amorphous Thermoplastic | 303 | Acrylic | None |
| Sample 6 (Invention) | Double annular snap of metal base insert to polymer cartridge case | Amorphous Thermoplastic | 303 | None | Alkoxy Cyanoacrylate |
| Sample 7 (Invention) | Double annular snap of metal base insert to polymer cartridge case | Amorphous Thermoplastic | 303 | None | Ethyl Cyanoacrylate (#2) |

Table 2 summarizes composition of a .308 caliber ammunition article based on polymer case annular snap fit feature (single or double), cartridge case polymer type, metal base insert type, and whether a sealant or adhesive were used to join the foregoing polymer cartridge case and metal base insert into a single piece assembly. The comparative samples and inventions were fully assembled ammunition articles and comprised of a projectile (bullet), primer and propellant along with the single piece assembly with or without the presence of a sealant or adhesive as so designated for each sample. The comparative samples and inventions remain as ammunition articles unless otherwise described.

Comparative sample A, consists of an amorphous thermoplastic resin injection molded into a polymer cartridge case with a single annular snap fit design feature molded-in. The case was joined with a 303 stainless steel metal base insert by the engagement of the snap fit features present on each individual part. This effectively engaged and secured the two components to form a single piece assembly without the use of a sealant or adhesive.

Comparative sample B, is a conventional .308 ammunition article constructed with a brass cartridge case. It is without a polymer cartridge case, metal base insert and sealant or adhesive. It is a comparative sample for which the lightweight features of the invention are compared.

Sample 1 is an example of the invention with design features of comparative sample A with the addition of an acrylic sealant 450. The sealant is located between the polymer cartridge case and metal base insert.

Sample 2 is an example of the invention with design features of comparative sample A using a 17-4PH metal base insert instead of a 303 stainless steel metal base insert. The 17-4 metal base insert has the same design features as the base insert used in comparative sample A. In addition, an ethyl cyanoacrylate as an adhesive was used and is located between the polymer cartridge case and metal base insert.

Sample 3 is an example of the invention with design features of comparative sample A, however the polymer cartridge case is molded using a glass filled amorphous polymer. A 17-4 metal base insert was used and is of the same design as comparative sample A. In addition, an ethyl cyanoacrylate as an adhesive was used and is located between the polymer cartridge case and metal base insert.

Sample 4 is an example of the invention using a double annular snap fit design on the polymer cartridge case injection molded using an amorphous polymer. The polymer cartridge case was joined together with a 303 stainless steel metal base insert by the act of engaging the snap features of each to firmly secure and form a single piece assembly without the use of a sealant or adhesive. Sample 4 is significantly different from comparative sample A in design since it uses a double snap fit feature as opposed to a single snap fit design. The double snap fit design was present on the polymer cartridge case as well as the metal base insert.

Sample 5 is an example of the invention with double annular snap fit as described in sample 4 with the addition of an acrylic sealant located between the polymer cartridge case and metal base insert.

Sample 6 is an example of the invention with double annular snap fit as described in sample 4 with the addition of an alkoxy cyanoacrylate adhesive located between the polymer cartridge case and metal base insert.

Sample 7 is an example of the invention with double annular snap fit as described in sample 4 with the addition of an ethyl cyanoacrylate adhesive located between the polymer cartridge case and metal base insert.

Test Methods

Axial Pullout Load Test Method

The axial pullout load mechanical test method for case assemblies consists of testing for peak load at break of a polymer cartridge case and metal base insert that are joined together as a single assembly. The single assembly used in axial pullout testing were without a projectile, primer or propellant present. The peak load at break measured the load required to separate the polymer cartridge case and metal base insert from each other and is analogous to the pullout or pulloff load separating two individual components from each other. The test measures the effectiveness of maintaining the annular snap fit, or any other joining method, of the metal base insert with the polymer cartridge case. The greater the pullout load, the more effective the snap fit, or other joining method, was at maintaining the assembly and is a desired result.

As used below and throughout, a "MTS" testing machine is referenced. MTS Systems Corp. makes the testing machine as described and is not indicative of any one testing procedure. Instron is another manufacture of testing machines who's testing machines could be used in the examples below.

The axial pullout load was measured using an MTS Exceed Model E44 electro-mechanical universal testing machine with a 30 kN load cell. The test template used is available on an MTS universal testing machine as "EM Tension (simplified)" version 4.2.0. This setup is similar to an ASTM tensile test however modified to hold the case assembly during testing as described in the proceeding paragraphs. The mechanical crosshead moved at a velocity of 0.2 inch/min (5 mm/min) during testing with data acquisition of 10 Hz. The MTS tester collected the resultant force as a function of displacement with the maximum reported as peak load (lbf). The test reached completion once peak load decreased by 90%, which indicated a separation of the polymer cartridge case from the metal base insert. The peak load (lbf) was recorded for each individual sample with an average of 3 samples reported for a specific polymer cartridge case and metal base insert assemblies and corresponding test temperature.

The polymer cartridge case and metal base insert assembly were tested with and without the presence of an adhesive or sealant located between the two mating parts. The addition of an adhesive or sealant improved mechanical integrity of the two materials but was not always necessary depending on the type of annular snap fit design, single or double. In the situation they are used, the assembly was prepared by applying an adhesive or sealant in an amount of 0.0450 g (+/−0.0050 g) and 0.0700 g (+/−0.0050 g) by weight respectively. The adhesive or sealant were directly applied to the surface of the metal base insert prior to engagement with the molded polymer cartridge case. The two parts were joined by pressing the snap features together until fully engaged therefore creating a single piece assembly. Parts assembled with a sealant or adhesive present were allowed to fully cure at 72° F. (22° C.) following manufacturer's recommendation. After cure, the assembly was conditioned for four hours at the desired test temperatures of −40° F. (−40° C.), 68° F. (20° C.), or 165° F. (74° C.) in a temperature controlled chamber to within +/−1° F. Testing was completed within one minute of removing the single piece assembly from the temperature controlled chamber. If a sealant or adhesive were not used, the single piece assembly was immediately placed in a temperature controlled chamber for 4 hours prior to testing.

The individual single piece assembly was removed from conditioning and directly placed into a MTS testing machine for testing. The bottom 0.300 inch (7.62 mm) of the metal base insert, as measured at its base, is placed in a retaining fixture to hold it uniformly around its circumference. The stationary retaining fixture is securely bolted to the base of the MTS testing machine to insure it remains in place without movement during testing. The single piece assembly is oriented with the metal base insert on the bottom while the polymer cartridge case in extended in a vertical top position.

In preparation for testing, the upper MTS test frame is lowered so an upper moving fixture can slide over the polymer cartridge case a distance of 0.960 inches (24.4 mm) as measured from the top of the polymer cartridge case down towards the metal base insert. The upper moving fixture holds the polymer cartridge case around its circumference and is constructed with a split with which two pinch bolts are tightened to close the fixture together to affix the polymer cartridge case. In addition, a set of pusher bolts in the upper fixture push from the opposite direction to allow closure to a preset distance. The pusher bolts prevent overtightening the pinch bolts to insure the fixture closes and contacts the polymer cartridge case the same each time. This creates a repeatable test method and uniformly applies pressure with minimal deformation of the polymer cartridge case without affecting test results.

Upon initiation of the test, the upper MTS test frame and upper moving fixture travel upwards in a vertical motion. The polymer cartridge case separates from the metal base insert because of a force being applied in tension. The peak load for which failure occurs is reported for each sample tested. From this test method, the effectiveness of the joining method of the metal base insert with the polymer cartridge case may be evaluated. In addition, other design and material variables including: mechanical designs, types of additives added for sealing, polymer formulations, insert metal type, types of additives added for mechanical joining properties, assembly techniques, and various temperature conditions may be evaluated.

Torsion Cantilever Maximum Load Test Method

The torsion cantilever mechanical test method for case assemblies consists of testing for maximum (also known as peak) load at break of a polymer cartridge case and metal base insert that are joined together as a single assembly. As discussed in the axial pullout load test procedures, the single assembly used were without a projectile, primer or propellant present. The maximum load at break measured the load required to separate the polymer cartridge case and metal base insert from each other. However, this test is analogous to a 3-point bend test in compression as it uses the MTS EM Flexure (3-point Bend) template version 4.2.1. and therefore measures a different failure mode from the previously described axial pullout test. The test measures the effectiveness of maintaining the annular snap fit, or any other joining method, and its ability to resist the flexing or torquing of the polymer cartridge case from the metal base insert. As with the axial pullout load test, the greater the maximum load the more effective the snap fit, or other joining method, was at maintaining the assembly.

As with the axial pullout load test, an MTS Exceed Model E44 electro-mechanical testing machine with a 30 kN load cell was used. However, the crosshead velocity was increased to 5 inch/min (127 mm/min) during testing with a data acquisition rate of 10 Hz. The MTS tester collected the resultant force as a function of displacement with the maximum reported as maximum load (lbf) which corresponds to a peak load. The test reached completion once maximum load decreased by 90%, which indicated a separation of the polymer cartridge case from the metal base insert. The maximum load (lbf) was recorded for each individual sample with an average of 2 samples reported for a specific polymer cartridge case and metal base insert assemblies and corresponding test temperature.

The polymer cartridge case and metal base insert assembly were tested with and without the presence of an adhesive or sealant located between the two mating parts. The addition of an adhesive or sealant improved mechanical integrity of the two materials but was not always necessary depending on the type of annular snap fit design, single or double. Details of sample preparation and conditioning were identical to the axial pullout test method as previously discussed.

The individual single piece assembly was removed from conditioning and directly placed into a MTS testing machine for testing. The bottom 0.100 inch (2.54 mm) of the metal base insert, as measured at its base, is placed in a retaining fixture to hold it uniformly around its circumference. The stationary retaining fixture is securely bolted to the base of the MTS testing machine to insure it remains in place without movement during testing. The single piece assembly is extended in a horizontal position with the metal base insert being held and the polymer cartridge case cantilevered out away from the retaining stationary fixture.

In preparation for testing, the upper MTS test frame and corresponding connected fixture is lowered until a horizontal, 0.500 inch (12.7 mm) diameter by 4.0 inch (101.6 mm) long, anodized steel bar on the fixture, makes contact with the polymer cartridge case. It is adjusted to insure the center of the 4.0 inch (101.6 mm) long bar is in contact with the polymer cartridge case. The bar is horizontal and perpendicular to the test specimen. The anodized steel bar point of contact on the polymer cartridge case is located at 1.560 inches (39.62 mm) as measured from the bottom of the metal base insert. The round steel bar has the ability to rotate during the test.

Upon initiation of the test, the upper MTS test frame and connected fixture travel down in a vertical motion as at a crosshead velocity of 5 inch/min (127 mm/min) therefore providing compression on the polymer cartridge case during the test and subsequently on the single assembly. The case assembly is tested until failure from the compression force being applied by the center of the anodized steel bar. Several failure modes may result and include, but not limited to, the polymer cartridge case fracture in two or more separate pieces or hanging in a hinged configuration from the metal base insert, or flexing which cause complete or partial separation of the polymer case cartridge from the metal base insert as a single piece or in multiple pieces, or any combination thereof.

The maximum load for which failure occurs is reported for each sample tested. From this test method, the effectiveness of the joining method of the metal base insert with the polymer cartridge case may be evaluated. In addition, other design and material variables including: mechanical designs, types of additives added for sealing, polymer formulations, insert metal type, types of additives added for mechanical joining properties, assembly techniques, and various temperature conditions may be evaluated.

Ammunition Article Firing Test Methods

The ammunition articles were prepared for firing and comprised of a projectile (bullet), primer and propellant along with the single piece assembly with or without the presence of a sealant or adhesive as so designated for each sample described in Table 2. The projectile (bullet) used was 7.62×51 cartridge with an M80 ball 147 gr projectile having a lead core and a muzzle velocity of 2750 ft/s (838 m/s). The primer used was a CCI #34 primer and the propellant used was 40.6 grains of WCR 845 powder. The projectile was provided sufficient propellant to obtain a velocity and pressure comparable to conventional brass ammunition.

The ammunition articles to be fired were linked together and conditioned in a temperature controlled chamber at test temperature for a period greater than 4 hours prior to testing. The conditioned temperatures ranged from −65° F. (−54° C.) to 165° F. (74° C.) and defines the polymer cartridge case temperature for which the article were used in the firearm. Upon removal from the temperature controlled chamber, the articles were immediately loaded and fired in the respective firearm. The actual firing event consisted of shooting bursts of 5-10 rounds in rapid-fire succession until the entire linked belt was emptied. Firing results are reported as a fraction with number of successful ammunition articles fired and remained intact in the numerator with the number of attempts listed as the denominator. The fraction was subsequently converted to a percentage and referenced by a number of terms such as success rate, pass rate, success percentage, pass percentage, percent success, and survival of firing event or any combination thereof. The success percent and fraction are reported together in all tables reporting firing results.

The assessment as to whether an ammunition article was successful and passed or unsuccessful and failed a firing event from a firearm was determined based on the loading, firing and removal of the cartridge from the chamber without interruption of the firing event or subsequent firing events. The removal process includes extraction, ejection or any other process, or combinations thereof, by which a fired ammunition article is removed from the chamber. A failure is defined as interruptions caused by, but not limited to, an ammunition article jammed, fractured, broken, splintered, or any other distortion resulting in stoppage or hesitation of a firing event. This includes light strikes where the ammunition article did not fire because of a problem with the primer upon being struck by the firing pin. There are potentially other failure modes not specifically detailed here and are related to the ammunition article, which result in an unsuccessful firing event and stoppage or hesitation of a firing event. In contrast, an ammunition article that successful and passes the firing event will do so without a problem with the spent (fired) cartridge and it remains as a single assembly and does not cause disruption, stoppage or hesitation in the operation of a firearm.

Weapon Platforms Used During Testing

As noted above and below, the polymer ammunition articles 100 were fired using various weapons platforms.

Each platform an example of a class of weapon the polymer ammunition articles 100 are designed to be used with.

One weapon system used is the M240 machine gun. The M240 is a general-purpose machine gun that can be mounted on a bipod, tripod, aircraft, or vehicle. The M240 is a belt-fed, air-cooled, gas-operated, fully automatic machine gun that fires from the open bolt position. The M240's max rate of fire is 950 rpm (rounds per minute) with a muzzle velocity of 2,800 ft/s and a maximum range of 3,725 m.

Ammunition is fed into the weapon from a 100-round bandoleer containing a disintegrating metallic split-link belt. The gas from firing one round provides the energy for firing the next round. Thus, the gun functions automatically as long as it is supplied with ammunition and the trigger is held to the rear. As the gun is fired, the belt links separate and are ejected from the side. Empty cases are ejected from the bottom of the gun. The M240 weighs between 22 and 27 pounds and is approximately 50 inches in length. The weapon is chambered to fire 7.62×51 mm caliber cartridges.

The M240 weapon system was chosen for testing because the M240 machine gun's ejection system applies approximately 5 times the ejection force of an AR style semi-automatic rifle and can over torque the insert 200 when extracting the cartridge 100, leading to the insert 200 being pulled from the body 102, leading to jamming. This additional torque produced by the ejector can cause the case to flex during extraction. This flex can lead to jamming of the firearm.

The Mk 48 is a gas-operated, air-cooled, belt-fed machine gun. The weapon is lighter than the M240 but still fires 7.62×51 mm caliber cartridges. The weapon was developed for use by United States Special Operations Command (USSOCOM) units. The Mk 48 is a portable machine gun with the firepower of the M240 and used by the Navy SEALS and Army Rangers. The Mk 48 weighs 18.26 pounds and is almost 40 inches long. The Mk 48's rate of fire is 730 rpm at an effective range of 800 meters.

The US Army M110 Semi-Automatic Sniper System is a semi-automatic medium sniper rifle in use with both regular and special operations forces within the US military. Firing 7.62×51 mm caliber projectiles and weighing in at 15.3 lbs. The M110 has a length of 45.4 inches, a barrel length of 20 inches and a muzzle velocity of 2,571 feet per second. The M110 tested was also suppressed.

Another weapon system used for testing was the M134 (a.k.a. Minigun). The Minigun is a 6-barrel electrically-operated Gatling gun that is mounted on vehicles, helicopters and boats. Based around a six bolt rotating unit, the minigun can fire at a very high rate of up to 6000 rounds per minute. The Minigun weighs 35.05 pounds at a length of 31.5 inches, with a barrel length of 21.85 inches. The Minigun also fires 7.62×51 mm caliber rounds at a muzzle velocity of 2,850 feet per second with an effective range of 1000 m.

A further weapon system used is a Universal Receiver. The Universal Receiver (UR) is a weapon action designed to accommodate common sized barrels in calibers from a .17 caliber up to a .50 caliber BMG. The UR features an open breech face design with a quick access barrel locking nut. In addition to quick change barrels, the universal receiver also has three different firing pins for the varying sized cartridges. The firing pins are sized for the three different primer sizes, small, large and 50 BMG. The firing pins and plate can be changed quickly and easily allowing the user to switch from small caliber pistol testing to large caliber rifle testing in a matter of minutes. The cartridge is manually loaded into the chamber of the barrel, the breech is closed, and the UR is fired by pulling a lanyard. Universal Receivers of this design are utilized across the entire industry to provide a reliable reference system for ammunition testing.

Note that all of the above weapons were chambered for 7.62×51 mm cartridges. 7.62×51 mm caliber cartridges are generally equivalent to .308 caliber cartridges and can generally be used interchangeably. In terms of technical specifications, there are differences between 7.62 and .308, but mainly in the chambers of rifles designed to fire each cartridge and not the cartridge itself. The 7.62 cartridge wall is a bit thicker, and commercial .308 is sometimes loaded to slightly higher pressure, but other than that, the cartridges themselves are very similar. For the testing, the cartridges were considered designed to .308 standards.

EXAMPLES

Example 1

The purpose of the example was to demonstrate a .308 caliber ammunition article as constructed and identified as comparative sample A, with a single annular snap of the metal base insert with the polymer cartridge case, was unable to pass firing tests in a belt fed, gas operated M240 firearm as a function of temperature. This was also to show inventive samples 1 and 2 with the addition of a sealant or adhesive and single annular snap design would improve the firing success rate defined as the number of successful ammunition cartridges fired divided by the number of attempts. It is shown as a fraction as well as a percentage.

TABLE 3

.308 Caliber Ammunition Article in M240 Firearm

| Ex. No. | Name | Sealant/ Adhesive | Ammo Cartridge Temperature −40 F.(−40 C.) | 68 F.(20 C.) | 165 F.(74 C.) | Comments |
|---|---|---|---|---|---|---|
| 1 | Sample A (comparative) | None | Not Tested | 0/2 (0%) | 0/2 (0%) | Gas leaks upon firing |
| 2 | Sample 1 (invention) | Acrylic | 60/60 (100%) | 50/50 (100%) | 35/50 (70%) | Metal insert separated from polymer cartridge case |
| 3 | Sample 2 (invention) | Ethyl Cyanoacrylate | Not Tested | Not Tested | 10/10 (100%) | All Passed at elevated temperature |

The results presented in Example 1, Table 3 show comparative sample A with a single annular snap of the metal base insert with the polymer cartridge case was unable to pass firing tests at 68° F. (20° C.) and 165° F. (74° C.). A total of 2 samples were fired at each temperature, which resulted in gas leakage and separation of a metal base insert from the polymer cartridge case during the firing event causing gun stoppage. In contrast, the addition of a sealant as with inventive Sample 1, significantly improved firing success rate to 100% at −40° F. (−40° C.) and 68° F. (20° C.) with 70% at an elevated temperature of 165° F. (74° C.). Sample 1 failures at elevated temperature were a result of the metal base insert and polymer cartridge case separating from each other and not remaining as a single piece assembly during the extraction and ejection processes. This resulted in stoppage of the firearm due to the gun jamming. The firing success rate increased further at elevated temperature to 100% with inventive sample 2, which used an adhesive as opposed to a sealant to keep the polymer cartridge case and metal base insert joined as a single piece assembly throughout the firing event. In addition, the presence of the adhesive and sealant prevented gas leakage upon firing of the ammunition article. This example demonstrates the proper selection sealant/adhesive will affect the results for the single annular snap design and the ability to improve success rate over a wide temperature range.

Example 2

The purpose of the example was to show inventive sample 1 with a sealant will not have a sufficient success rate at elevated temperature when fired from a M240 firearm, however was sufficient for use in an Mk48 firearm. This was to demonstrate firearms have significantly different requirements for ammunition articles and an M240 is more demanding because of the extraction and ejection processes as compared to an Mk48 firearm.

TABLE 4

.308 Caliber Ammunition Article in Mk48 and M240 Firearm

| Ex. No. | Name | Sealant | Firearm | Ammo Cartridge Temp. −40 F.(−40 C.) | 68 F.(20 C.) | 165 F.(74 C.) | Comments |
|---|---|---|---|---|---|---|---|
| 1 | Sample A (comparative) | None | M240 | Not Tested | 0/2 (0%) | 0/2 (0%) | Gas leaks upon firing |
| 2 | Sample 1 (invention) | Acrylic | M240 | 60/60 (100%) | 50/50 (100%) | 35/50 (70%) | Metal insert separated from polymer cartridge case |
| 6 | Sample 1 (invention) | Acrylic | Mk48 | 50/50 (100%) | 50/50 (100%) | 50/50 (100%) | All Passed |

The results presented in Example 2, Table 4 show inventive sample 1 with a sealant was able to achieve 100% success rate for a belt consisting of 50 rounds fired at −40° F. (−40° C.), 68° F. (20° C.) and 165° F. (74° C.) temperatures. The polymer cartridge case and metal base insert remained a single assembly for the duration of the loading, firing and removal processes. It also demonstrated the significance of maintaining integrity of the polymer cartridge case and metal base insert assembly. As demonstrated with sample 1 fired in an M240 with only a 70% success rate, the requirement for maintaining a single assembly is much higher in that specific type of firearm. This becomes more important in subsequent examples where the pulloff peak load and torsion cantilever maximum load requirements of a single assembly are established for the two different types of firearms.

Example 3

The purpose of this example was to demonstrate firing a .308 caliber ammunition article at the Naval Surface Warfare Center (NSWC) located at Crane, Indiana in an Mk48 and Minigun firearms as a function of temperature.

TABLE 5

.308 Caliber Ammunition Article in Mk48 and Minigun Firearm at NSWC Crane

| Ex. No. | Name | Sealant | Firearm | Ammo Cartridge Temp. −25 F.(−32 C.) | 70 F.(21 C.) | 165 F.(74 C.) | Comments |
|---|---|---|---|---|---|---|---|
| 7 | Sample 1 (invention) | Acrylic | Mk48 | 100/100 (100%) | 100/100 (100%) | 100/100 (100%) | All Passed |
| 8 | Sample 1 (invention) | Acrylic | Minigun | 198/200 (99%) | 199/200 (99.5%) | 199/200 (99.5%) | Light Strikes |

The results presented in Example 3, Table 5 demonstrates a success rate of 100% for a .308 caliber ammunition article fired in a Mk48 and greater than 99% in a minigun for inventive sample 1. The Mk48 firearm was belt fed with 100 rounds linked and conditioned overnight for approximately 20 hours at firing temperatures of −25° F. (−32° C.), 70° F. (21° C.), and 165° F. (74° C.). Measured pressures and velocities were comparable to those obtained using conventional brass ammunition. The minigun fired at a rate of 50-54 rounds/sec using a 200 round linked belt conditioned in a similar fashion as rounds used in the Mk48 firearm. There was at least 1 failure at each temperature with the cause attributed to light strikes, i.e. primer not seating properly in cartridge. The experimental results confirm results reported in Example 2, Table 4.

Example 4

The purpose of this example was to demonstrate the effectiveness of selecting an adhesive, which keeps the polymer cartridge case and metal base insert joined together as a single piece assembly during the loading, firing and removal processes. It also prevents any leakage of gas generated within the cartridge and during the firing event from escaping. In addition, it prevents external moisture or any other potential contaminant in the surroundings from entering the cartridge.

TABLE 6

| Materials in .308 Caliber Ammunition Article in M240 Firearm | | | | | | |
|---|---|---|---|---|---|---|
| | | Sealant/ | | Ammo Cartridge Temp | | |
| Ex. No. | Name | Adhesive | Polymer Type | 68 F.(20 C.) | 165 F.(74 C.) | Comments |
| 1 | Sample A (comparative) | None | Unfilled | 0/2 (0%) | 0/2 (0%) | Gas leaks upon firing |
| 3 | Sample 2 (invention) | Ethyl Cyanoacrylate | Unfilled | Not Tested | 10/10 (100%) | All Passed |
| 11 | Sample 3 (invention) | Ethyl Cyanoacrylate | Glass Filled | 10/10 (100%) | 10/10 (100%) | All Passed |

The results presented in Example 4, Table 6 show the effect an adhesive; polymer type and firing temperature have on the success rate of fire in a M240 firearm. Ethyl Cyanoacrylate used in sample 2 and 3 was very effective at keeping the polymer cartridge case and metal base insert together and resulted in 100% success rate as a function of temperature. The critical role the adhesive plays and importance of maintaining the casing as a single piece assembly without fracture was demonstrated by constructing the polymer cartridge case using a glass filled amorphous resin as shown with Inventive sample 3. A success rate of 100% at 68° F. (20° C.) and 165° F. (74° C.) resulted for sample 3. The glass filled polymer with lower ductility than an unfilled amorphous polymer was able to successfully fire all 10 rounds at each temperature condition in the demanding M240 firearm. In addition, this example again shows that even though the single annular snap design of comparative example 1 by itself cannot achieve the required success levels, the use of an adhesive to maintain a single piece assembly can significantly improve performance.

adhesive for firing in an Mk48 and M240 firearm. For example, inventive sample 1, was successful in an Mk48 but did not achieve the same level of success in a M240. The M240 extraction and ejection processes are more severe and therefore require higher performance levels and greater demands on an ammunition article to survive intact. It is therefore important to recognize it is more difficult for an ammunition article to achieve high success rates in a M240 than an Mk48 or similar firearms.

TABLE 7

| Axial Pulloff Load and Cantilever Torsion Test of Ammunition Cartridge Case | | | | | | | | |
|---|---|---|---|---|---|---|---|---|
| | | | Axial Pulloff Load (lbf) | | | Cantilever Maximum Load (lbf) | | |
| Ex. No. | Name | Sealant/ Adhesive | −40 F. (−40 C.) | 68 F. (20 C.) | 165 F. (74 C.) | −40 F. (−40 C.) | 68 F. (20 C.) | 165 F. (74 C.) |
| 12 | Sample A (comparative) | None | 65 | 79 | 61 | 24 | 21 | 17 |
| 13 | Sample 1 (invention) | Acrylic | 100 | 102 | 86 | 35 | 28 | 27 |
| 14 | Sample 2 (invention) | Ethyl Cyanoacrylate | 172 | 253 | 176 | 49 | 63 | 53 |

Example 5

The purpose of the example was to quantify the axial pulloff load (lbf) and torsion cantilever maximum load (lbf) necessary for the single piece assembly to remain intact and not separate or fracture resulting in jamming and therefore stoppage of a firearm such as an Mk48 or minigun. It had already been demonstrated in examples 2 and 3 a difference in firearms required performance levels significantly different from each other in order to obtain success rates near 100% especially as a function of temperature. This was particularly evident when comparing success rates for specific inventive samples with the presence of a sealant or The results presented in Example 5, Table 7 are based on test procedures previously described elsewhere and are measurements on an unfired polymer cartridge case and metal base insert single piece assembly.

The axial pulloff peak load (lbf) for comparative sample A ranged from 61 to 79 lbs over a temperature range of −40° F. (−40° C.) to 165° F. (74° C.). Inventive samples 1 and 2 with the presence of a sealant and adhesive were much higher over the same temperature range by a factor, on average, of 1.4× and 2.9× respectively. The test measures the effectiveness of maintaining the annular snap fit, or any other joining method, of the metal base insert with the polymer cartridge case. The greater the pullout load, the more effective the snap fit, or other joining method, was at maintaining the assembly and is a desired result.

The torsion cantilever maximum load (lbf) for comparative sample A ranged from 17 to 24 lbf over the temperature range evaluated whereas inventive samples 1 and 2, were much greater with ranges of 27 to 35 and 49 to 63 lbf respectively. An average factor increase of 1.45× and 2.7× for inventive samples 1 and 2 as compared to sample A. The torsion cantilever maximum load test measures the effectiveness of maintaining the annular snap fit, or any other joining method, and its ability to resist flexing or torquing of the polymer cartridge case from the metal base insert. As with the axial pullout load test, the greater the maximum load the more effective the snap fit, or other joining method, was at maintaining the assembly.

The inventive samples 1 and 2 in the example demonstrate the effectiveness a sealant or an adhesive have in contributing to the integrity of the single piece assembly. However, the contribution of the sealant was less than the adhesive since its bonding strength was lower and was initially included to prevent internal gases from escaping externally. The adhesive sealed as well as provided additional bounding strength. An important aspect of the invention was designing in features to maintain the integrity of the snap fit, or any other joining method, such the two mating parts remain intact over the temperature range for which firing occurs and subsequent aggressive extraction and ejection (i.e. removal) processes. The ammunition article must survive intact without fracture or deformation for the firearm to remain operational.

Example 6

The purpose of this example was to introduce the effectiveness of the double annular snap design as compared to the single annular snap design. The single annular design relies on a sealant or adhesive as the primary means of keeping the polymer cartridge case and metal base insert together to have a sufficient pass rate in a firearm. This experiment is to show another joining method such as a double annular snap fit design can be used as the primary method of keeping the polymer cartridge case and metal base insert together as a single assembly without the need of a sealant or adhesive. The sealant or adhesive however can be used as an environmental seal (i.e. keep moisture out) and to assist in preventing gases formed during the firing event in the cartridge from escaping.

TABLE 8

.308 Caliber Ammunition Article in M240 Firearm

| Ex. No. | Name | Sealant/ Adhesive | Ammo Cartridge Temperature −25 F.(−32 C.) | 68 F.(20 C.) | 165 F.(74 C.) | Comments |
|---|---|---|---|---|---|---|
| 1 | Sample A (comparative) | None | Not Tested | 0/2 (0%) | 0/2 (0%) | Gas leaks upon firing |
| 16 | Sample 4 (invention) | None | 10/10 (100%) | Not Tested | 10/10 (100%) | All Passed |
| 17 | Sample 5 (invention) | Acrylic | 25/25 (100%) | 25/25 (100%) | 25/25 (100%) | All Passed |
| 18 | Sample 7 (invention) | Ethyl Cyanoacrylate | 25/25 (100%) | 25/25 (100%) | 25/25 (100%) | All Passed |

It was determined that the ammunition article firing success rate was related to the axial pullout peak load and torsion cantilever maximum load with greater values correlating to higher success rates until a threshold value was exceeded and 100% success achieved. The threshold value was determined to be temperature dependent since other temperature dependent material properties of the polymer used in the cartridge case contribute to the overall performance of the assembly. Material properties such as tensile yield strength, tensile modulus, ductility, flexural strength and modulus are a few which contribute to performance. The mechanical properties listed are not meant to be a complete list but examples of properties for which temperature dependency is important. As presented and discussed in example 1 Table 3 for a M240 firearm, the success rate of comparative sample A was 0% at test temperatures subsequently leaked gas. Inventive sample 1 success rate was as high as 100% at −40° F. (−40° C.) and 68° F. (20° C.) with a low of 70% at elevated temperature, while inventive sample 2 achieved 100% at the elevated temperature. This was expected based on results of the axial and torsion cantilever tests, which predicts samples with higher peak, and maximum loads, would result in higher success rates for the M240. In contrast, example 3 Table 5 present a greater than 99% success rate for Mk48 and minigun firearms for inventive sample 1 since axial pullout peak load and torsion cantilever maximum load exceeded the necessary threshold value for it to work at temperature and for the firearms tested.

The results presented in example 6, Table 8 demonstrate the effectiveness of maintaining the polymer cartridge case and metal base insert together using a double snap fit as the joining method as a single assembly in a M240 firearm. Inventive sample 4, with a double annular snap fit without a sealant or adhesive present had a success rate of 100% without gas leakage at −25° F. (−32° C.) and 165 F (74° C.) test temperatures. This was a substantial improvement from comparative sample A that was unsuccessful at any test temperature with gas leakage. Inventive samples 5 and 7, consisted of a double annular snap fit with an acrylic sealant and ethyl cyanoacrylate respectively. The success rate for each sample was 100% at −25° F. (−32° C.), 68° F. (20° C.) and 165° F. (74° C.). The sealant and adhesive provided a secondary means of maintaining seals for which success was not dependent.

Example 7

The purpose of the example was to quantify the axial pulloff peak load (lbf) and torsion cantilever maximum load (lbf) necessary for the single piece assembly to remain intact and not separate or fracture resulting in jamming and therefore stoppage of a M240 firearm. In addition, the purpose of the example is also to show how a joining method can maintain the single piece assembly together and be the primary means it remains together as a single piece without the reliance of a sealant or adhesive.

TABLE 9

Axial Pulloff Load and Cantilever Torsion Test of Ammunition Cartridge Case

| Ex. No. | Name | Sealant/ Adhesive | Axial Pulloff Load (lbf) −40 F. (−40 C.) | Axial Pulloff Load (lbf) 68 F. (20 C.) | Axial Pulloff Load (lbf) 165 F. (74 C.) | Cantilever Maximum Load (lbf) −40 F. (−40 C.) | Cantilever Maximum Load (lbf) 68 F. (20 C.) | Cantilever Maximum Load (lbf) 165 F. (74 C.) |
|---|---|---|---|---|---|---|---|---|
| 12 | Sample A (comparative) | None | 65 | 79 | 61 | 24 | 21 | 17 |
| 19 | Sample 4 (invention) | None | 240 | 235 | 237 | 53 | 49 | 43 |
| 20 | Sample 5 (invention) | Acrylic | 243 | 247 | 254 | 62 | 58 | 59 |
| 21 | Sample 6 (invention) | Alkoxy Cyanoacrylate | 266 | 261 | 258 | 66 | 65 | 60 |
| 22 | Sample 7 (invention) | Ethyl Cyanoacrylate | 269 | 276 | 295 | 62 | 62 | 65 |

The results presented in example 7, Table 9 are based on test procedures previously described elsewhere and are measurements on an unfired polymer cartridge case and metal base insert joined together as a single piece assembly.

The axial pulloff peak load (lbf) for inventive sample 4 ranged from 235 to 240 lbf over a temperature range of −40° F. (−40° C.) to 165° F. (74° C.). This was substantially greater than the axial peak load of comparative sample A which ranged from 61 to 79 lbf. This represented an increase by a factor of 3.47× based on average peak load over the temperature range evaluated. The significant difference between the two explains the success rate of 100% versus 0% when fired in an M240 firearm for inventive sample 4 and comparative sample A respectively. In addition, inventive samples 5, 6 and 7 with the presence of a sealant or an adhesive demonstrated average axial pulloff peak loads of 248, 262 and 280 lbf based on the three values reported over the temperature range of −40° F. (−40° C.) to 165° F. (74° C.). The increase in axial peak load for inventive samples 6 and 7 as compared to sample 4 was anticipated since adhesives provide additional bounding strength between the polymer cartridge case and metal base insert. The acrylic sealant in inventive sample 5 incrementally increased axial peak load from those levels obtained in inventive sample 4. In general, inventive samples 4, 5, 6 and 7 were all significant greater and improved from comparable sample A. The inventive samples could withstand much high loads than comparative sample A, therefore resist fracture or separation of the single piece assembly into various parts and subsequently result in success in a M240 firearm.

The torsion cantilever maximum load (lbf) for inventive sample 4 ranged from 43 to 53 lbf over the temperature range of −40° F. (−40° C.) to 165° F. (74° C.). This was substantially greater than the maximum load achieved by comparative sample A, which ranged from 17 to 24 lbf over the same temperature range. The improvement by a factor of 2.3× based on the average of results reported in Table 9. Inventive samples 5, 6 and 7 with the presence of a sealant or adhesive and were also significantly improved over comparative sample A and as a group ranged from 58 to 66 lbf. The use of a sealant in inventive sample 5 increased the cantilever maximum load by a factor of 1.23× (23% increase) over sample 4, which relied solely on the double annular snap fit as the joining method. The use of an alkoxy and ethyl cyanoacrylates in samples 6 and 7, resulted in similar peak loads with an average of 63 lbf over the temperature range evaluated. The improvement in torsion cantilever maximum load test was of importance since the test method simulates the flexing and torquing of an ammunition article as done in the extraction and ejection processes of a M240 firearm. The sample failures in the test method were similar to fractures and the separation of the polymer cartridge case and metal base insert witnessed when using a M240 firearm. A high torsion maximum load values were desired as the test method measures the effectiveness of maintaining the individual components as a single piece assembly.

It was determined that the ammunition article firing success rate was related to the axial pullout peak load and torsion cantilever maximum load with greater values correlating to higher success rates in a M240 firearm. There are threshold values, which need to be obtained to achieve a 100% success rate. As shown with inventive sample 2, example 4 Table 6, a single annular snap fit as the joining method with the presence of a cyanoacrylate adhesive was 100% successful in a M240 firearm. This was demonstrated for all inventive samples, which used a double snap fit with and without the presence of a sealant or adhesive. Inventive samples 4,5,6 and 7 all achieved success rates of 100% in a M240 firearm. The common thread between all the inventive samples is having achieved high axial pulloff peak loads and torsion cantilever maximum loads at the temperature for which they were fired in a M240. The threshold values in each test were exceeded regardless if the joining method was a primary or secondary means of maintaining the polymer cartridge case and metal base insert together as a single piece assembly. The adhesive can be and was the primary means in inventive sample 2. The threshold values for a M240 firearm must be exceeded to have a success rate of 100% for a temperature range of −40° F. (−40° C.) to 165° F. (74° C.).

Example 8

The purpose of the example was to demonstrate the change in torsion cantilever maximum load (lbf) of a single piece assembly after firing as compared to an unfired condition. This was to show how the pressure created from the firing event changes the torsion cantilever maximum load as a result of an extreme pressure rise in the ammunition article during the firing event.

TABLE 10

| Torsion Cantilever Load Test of Ammunition Cartridge Case Fired in Test Barrel. | | | | |
|---|---|---|---|---|
| | | | Cantilever Maximum Load (lbf) at 68 F. (20 C.) | |
| Ex. No. | Name | Sealant/ Adhesive | Maximum Load Difference (After Firing − As Assembled) | Change |
| 23 | Sample 4 (invention) | None | 4.4 | 19% |
| 24 | Sample 5 (invention) | Acrylic | 6.1 | 23% |
| 25 | Sample 7 (invention) | Ethyl Cyanoacrylate | −1.6 | −5% |

The results presented in example 8, Table 10 shows results demonstrating the torsion cantilever maximum load difference measured on an unfired versus a fired single assembly. The test measures effectiveness of maintaining the annular snap fit, or any other joining method, and its ability to resist flexing or torquing of the polymer cartridge case from the metal base insert. The greater the load, the more resilient the assembly is and will stay together during the loading, firing and removal from a firearm. The results from this example demonstrate an inventive step in the design of the annular snap fit such that once the polymer cartridge case and metal base insert are joined as a single assembly, there is an area or volume of free space that is void of anything. The free space accommodates the plastic deformation or yielding of the polymer as the ammunition article is fired and pressures on the order of 60,000 psi (414 MPa) in a few milliseconds are generated. Plastic deformation of the polymer cartridge case fills the free space resulting in a tighter more stringent snap fit engagement with the metal base insert. It also provides space for the sealant or adhesive, if used, to be located. The design feature of adding a volume or area of free space could be applied to any joining method and is not unique to a snap fit design.

The inventive sample 4 using a double annular snap fit demonstrated the unique feature of polymer plastic deformation during the firing event. The torsion cantilever maximum load increased by 4.4 lbf (19%) from its initial value after firing at 68° F. (20° C.). A similar result occurred with inventive sample 5 with an acrylic sealant present. An increase of 6.1 lbs (23%) resulted after firing. In contrast, sample 7 with an ethyl cyanoacrylate decreased by 1.6 lbs (−5%) after being fired. This resulted, as the cyanoacrylate used was rigid upon cure and thus filled the space and prevented plastic deformation of cartridge. The sealant however was not rigid and could compress therefore allowing for plastic deformation in a similar fashion as sample 4.

Example 9

The purpose of the example was to demonstrate inventive sample 5, double annular snap fit with acrylic sealant, was successfully fired over a temperature range of −65° F. (−55° C.) to 165° F. (74° C.) in M240, Mk48 and M110 firearms.

TABLE 11

| .308 Ammunition Article Fired in Different Firearms | | | | | |
|---|---|---|---|---|---|
| | | Ammo Cartridge Temperature | | | |
| Ex. No. | Firearm | −65 F. (−55 C.) | −40 F. (−40 C.) | 68 F. (20 C.) | 165 F. (74 C.) |
| 26 | M240 | 200/200 (100%) | 400/400 (100%) | 200/200 (100%) | 647/650 (99.5%) |

TABLE 11-continued

| .308 Ammunition Article Fired in Different Firearms | | | | | |
|---|---|---|---|---|---|
| | | Ammo Cartridge Temperature | | | |
| Ex. No. | Firearm | −65 F. (−55 C.) | −40 F. (−40 C.) | 68 F. (20 C.) | 165 F. (74 C.) |
| 27 | Mk48 | 50/50 (100%) | 99/100 (99%) | 150/150 (100%) | 147/150 (98%) |
| 28 | M110 w/suppressor | 20/20 (100%) | Not Tested | 20/20 (100%) | 20/20 (100%) |

The results presented in example 9, Table 11 show firing results of inventive sample 5 with an acrylic sealant, for a temperature range of −65° F. (−55° C.) to 165F° (74° C.) in a M240, Mk48 and M110 firearm. The M240 and Mk48 firearms used a belt with linked ammunition of 50 to 100 rounds to feed ammunition articles to the firearm whereas the M110 with suppressor fired 20 round magazines. The trials with greater number of rounds listed should be understood to consist of a multiple number of linked belts to reach the number of founds fired. The success rate ranged from 98 to 100% with number of ammunition articles successfully fired presented in the numerator with number attempted in the denominator. Results were also reported as a percentage and are subsequently listed under the fraction. The ammunition articles loaded, fired, and removed without firearm stoppage or hesitation. The polymer cartridge case and metal base insert remained joined as a single assembly for the duration of the testing. The only failures recorded were light strikes where the primer did not cause the ammunition article to fire.

The examples above illustrate that polymer ammunition articles can be designed to function across a wide temperature range and fired in weapon systems with high ejection force. Part of the driving force to develop polymer ammunition article is the weight savings. An unloaded polymer cartridge (without primer, propellant and projection) is approximately 50% lighter than an unloaded brass cartridge. Once the polymer ammunition article is fully loaded there is a 20 to 25% weight reduction compared to the brass equivalent.

Note that in the examples above, the present invention can be used for any case in any caliber, either presently known or invented in the future. While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

The invention claimed is:

1. An ammunition article comprising:

a polymer cartridge case comprising:

a mouth at a first end;

a second end opposite the first end; and a propellant chamber located between the first end and the second end;

a projectile fitted into the mouth;

a metal base insert joined at the second end and comprising a primer;

wherein the metal base insert and the polymer cartridge case remain joined together as a single piece assembly upon loading, firing and removal from a chamber of a firearm for a polymer case temperature between about −65° F. (−54° C.) to 165° F. (74° C.), and wherein the polymer cartridge comprises a polymer consisting essentially of a thermoplastic polymer, a polymer blend or mixtures thereof and may include homopolymers, copolymers or combinations thereof, and wherein the polymer comprises about 5-10 wt % of milled glass.

2. The article of claim 1, wherein the article is used in an M240 automatic rifle firearm and the metal base insert is joined to the polymer cartridge case such that the single piece assembly prior to firing exhibits two more of the following mechanical properties:

an axial pullout peak load greater than 150 lbf at −40° F. (−40° C.) as measured with a universal test machine at a strain rate of 0.2 inches (5 mm) per minute;

an axial pullout peak load greater than 175 lbf at 68° F. (20° C.) as measured with the universal test machine at a strain rate of 0.2 inches (5 mm) per minute;

an axial pullout peak load greater than 150 lbf at 165° F. (74° C.) as measured with the universal test machine at a strain rate of 0.2 inches (5 mm) per minute;

an axial pullout peak load ratio exceeding 0.90 as determined by the ratio of pullout peak load at 68° F. (20° C.) to the pullout peak load of 165° F. (74° C.) as measured with the universal test machine at a strain rate of 0.2 inches (5 mm) per minute;

a torsion cantilever maximum load greater than 32 lbf at −40° F. (−40° C.) as measured with an MTS universal test machine at a strain rate of 5 inches (127 mm) per minute;

a torsion cantilever maximum load greater than 35 lbf at 68° F. (20° C.) as measured with an MTS universal test machine at a strain rate of 5 inches (127 mm) per minute;

a torsion cantilever maximum load greater than 32 lbf at 165° F. (74° C.) as measured with an MTS universal test machine at a strain rate of 5 inches (127 mm) per minute; and a torsion cantilever maximum load ratio exceeding 0.90 as determined by the ratio of the torsion cantilever maximum load at 68° F. (20° C.) to the torsion cantilever maximum loads at 165° F. (74° C.) as measured with the universal test machine as a strain rate of 5 inches (127 mm) per minute.

3. The article of claim 2, wherein an adhesive, a sealant, an epoxy or combination thereof is used to join, seal, bond or provide structural strength or toughness to prevent separation of the metal base insert and the polymer cartridge case single piece assembly into two or more separate parts.

4. The article of claim 1, wherein the article is use in a firearm other than an M240 and the metal base insert is joined to the polymer cartridge case such the assembly prior to firing exhibits two or more of the following mechanical properties:

an axial pullout peak load greater than 65 lbf at −40° F. (−40° C.) as measured with a universal test machine at a strain rate of 5 mm (0.2 inches) per minute;

an axial pullout peak load greater than 80 lbf at 68° F. (20° C.) as measured with the universal test machine at a strain rate of 5 mm (0.2 inches) per minute;

an axial pullout peak load greater than 60 lbf at 165° F. (74° C.) as measured with the universal test machine at strain rate of 5 mm (0.2 inches) per minute;

an axial pullout peak load ratio exceeding 1.25 as determined by the ratio of pullout peak load at 68° F. (20° C.) to the pullout peak load of 165° F. (74° C.) as measured with the universal test machine at a strain rate of 5 mm (0.2 inches) per minute;

a torsion cantilever maximum load greater than 25 lbf at −40° F. (−40° C.) as measured with the universal test machine at a strain rate of 127 mm (5 inches) per minute;

a torsion cantilever maximum load greater than 20 lbf at 68° F. (20° C.) as measured with the universal test machine at a strain rate of 127 mm (5 inches) per minute;

a torsion cantilever maximum load greater than 15 lbf at 165° F. (74° C.) as measured with the universal test machine at a strain rate of 127 mm (5 inches) per minute; and a torsion cantilever maximum load ratio exceeding 1.25 as determined by the ratio of cantilever maximum load at 68° F. (20° C.) to the cantilever maximum load 165° F. (74° C.) as measured with the universal test machine at a strain rate of 127 mm (5 inches) per minute.

5. The article of claim 1, wherein the metal base insert is joined to the polymer cartridge case in a single piece assembly; and wherein the assembly has a torsion cantilever maximum load after firing is greater than the assembly before being fired, as measured at 68° F. (20° C.) with a universal test machine at a strain rate of 127 mm (5 inches) per minute.

6. The article of claim 1, wherein there is no intervening material, adhesive, sealant, gasket, or o-ring between the metal base insert and the polymer cartridge case; and wherein the metal base insert is joined to the polymer cartridge case in a single piece assembly.

7. The article of claim 1, wherein the metal base insert is made of 17-4 precipitation-hardening (17-4PH) stainless steel.

* * * * *